US012529295B2

(12) United States Patent
Verma et al.

(10) Patent No.: US 12,529,295 B2
(45) Date of Patent: Jan. 20, 2026

(54) LIQUID LOADED WELL UNLOADING REDUCTION SYSTEM

(71) Applicant: Schlumberger Technology Corporation, Sugar Land, TX (US)

(72) Inventors: Sandeep Verma, Cambridge, MA (US); Kashif Rashid, Cambridge, MA (US); Abhishek Sharma, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 85 days.

(21) Appl. No.: 18/720,747

(22) PCT Filed: Jan. 17, 2023

(86) PCT No.: PCT/US2023/060723
§ 371 (c)(1),
(2) Date: Jun. 17, 2024

(87) PCT Pub. No.: WO2023/137480
PCT Pub. Date: Jul. 20, 2023

(65) Prior Publication Data

US 2025/0052139 A1 Feb. 13, 2025

Related U.S. Application Data

(60) Provisional application No. 63/300,032, filed on Jan. 16, 2022.

(51) Int. Cl.
*E21B 43/12* (2006.01)
*E21B 34/02* (2006.01)

(52) U.S. Cl.
CPC ..... *E21B 43/13* (2020.05); *E21B 34/025* (2020.05)

(58) Field of Classification Search
CPC ..... E21B 34/025; E21B 43/13
See application file for complete search history.

(56) References Cited

U.S. PATENT DOCUMENTS

| | | | | |
|---|---|---|---|---|
| 3,372,650 | A * | 3/1968 | Garrett | E21B 43/123 417/115 |
| 7,422,064 | B1 * | 9/2008 | Yang | E21B 43/168 166/309 |
| 2012/0090851 | A1 * | 4/2012 | Irwin, Jr. | E21B 43/126 166/107 |
| 2015/0377000 | A1 * | 12/2015 | Bollingham | E21B 43/168 166/57 |
| 2024/0218765 | A1 * | 7/2024 | Gambaretto | E21B 43/166 |
| 2024/0328289 | A1 * | 10/2024 | Rashid | E21B 43/122 |

FOREIGN PATENT DOCUMENTS

| | | |
|---|---|---|
| CN | 112943181 A | 6/2021 |
| WO | 2023039025 A1 | 3/2023 |

OTHER PUBLICATIONS

Joseph, A. et al., "Classification And Management of Liquid Loading in Gas Wells" SPE-167603-MS, SPE Nigeria Annual International Conference and Exhibition, Aug. 5, 2013, pp. 1-25.

* cited by examiner

*Primary Examiner* — Shane Bomar
(74) *Attorney, Agent, or Firm* — Jeffrey D. Frantz

(57) ABSTRACT

A method can include implementing a control scheme for a plurality of wells; using the control scheme, classifying each of the wells; based on the classifying, identifying one or more of the wells as experiencing liquid loading; and issuing a control instruction to perform an unloading operation for the one or more of the wells.

20 Claims, 22 Drawing Sheets

750

1000

1010 Steady State

- Maintain constant gas rate
- Autonomus choke control
- Maximum liquid drainage and no need for manual unloads

| Data Driven Approach | | |
|---|---|---|
| IF $(P_T - P_L)/P_T > a$ | | GR = 1.03 GR |
| IF $\Delta P_T$ [0.99 1.01] | And $(P_T - P_L)/P_T > b$ | GR = 1.02 GR |
| IF $\Delta P_T < 0.99$ | And $(P_T - P_L)/P_T < b$ | GR = 0.98 GR |
| IF Fcut < 400 | $C_{Trigdly}$ = 30 mins | Shut |
| IF $(P_T - P_L)/P_T > c$ | | Open |
| $P_T/P_T > d$ | | Open |

1020 Intermittent Well

- Average reservoir support
- Maximize well production time
- Minimize time well is producing bellow critical velocity

| Data Driven Approach | | |
|---|---|---|
| IF $P_T >= e$ | | Open |
| IF $\Delta P_T < 2\%$ in 60 mins | | Open |
| IF $\Delta P_C / \Delta t > 0$ for 5 mins | And GR < Fcut for $C_{Trigdly}$ mins | Shut |

1030 Well Unloading

- Identify wells experiencing liquid loading and send targeted alarms
- Self unloading for short duration cycles
- Autonomously return wells to normal operations

| For Open Well: | | |
|---|---|---|
| IF $(P_C - P_T)/P_C > z$ for 30 mins | And $(\Delta P_C / \Delta t >= 0)$ And well is producing | Unload = True |

| For Shut Well: | | |
|---|---|---|
| IF $P_T / P_C <= f$ | Resume Normal Operation | Unload = False |

| Else: | | |
|---|---|---|
| IF $P_T - P_C >= f$ for 30 mins | And $\Delta P_T < (0.5\%)$ over 120 mins | Start Unload = True |
| IF $\Delta P_C / \Delta t >= 0$ for $C_{Trigdly}$ = 5 mins | Or (Flowct < 300 for $C_{Trigdly}$ = 5 mins) | Shut |

| | |
|---|---|
| $P_T$ = Tubing pressure | a, b, c, d, = Steady state flow indicators |
| $P_C$ = Casing pressure | e = Open well indicator |
| $P_L$ = Line pressure | f = Unloading completion indicator |
| Fcut = Flow rate cut off | z = Liquid loading onset indicator |
| $C_{Trigdly}$ = Shut off delay time | GR = Gas rate setpoint |

FIG. 10

Monitoring and Control Dashboard

1310

Unloading

| Well Name | M1 | M2 | Pilot | Production Gain (Pilot - M2) |
|---|---|---|---|---|
| 1 | 11 | 15 | 0 | 1,526 |
| 2 | 11 | 11 | 0 | 3,282 |

1320

LIQUID LOADED WELL UNLOADING REDUCTION SYSTEM

CROSS-REFERENCE TO RELATED APPLICATION(S)

The subject disclosure claims priority from U.S. Provisional Appl. No. 63/300,032, filed on 16 Jan. 2022, herein incorporated by reference in its entirety.

BACKGROUND

Various techniques can be utilized for artificial-lift, which can, for example, help to produce fluid from a reservoir, etc. Gas-lift is a type of artificial-lift where, for example, gas can be injected into production tubing to reduce hydrostatic pressure of a fluid column. In such an approach a resulting reduction in bottom hole pressure can allow reservoir fluid to enter a wellbore at a higher flow rate. In various instances, injection gas can be conveyed down a tubing-casing annulus and enter a production train through one or more gas-lift valves.

SUMMARY

A method can include implementing a control scheme for a plurality of wells; using the control scheme, classifying each of the wells; based on the classifying, identifying one or more of the wells as experiencing liquid loading; and issuing a control instruction to perform an unloading operation for the one or more of the wells. A system can include a processor; memory accessible to the processor; processor-executable instructions stored in the memory and executable by the processor to instruct the system to: implement a control scheme for a plurality of wells; using the control scheme, classify each of the wells using classifications; based on the classifications, identify one or more of the wells as experiencing liquid loading; and issue a control instruction to perform an unloading operation for the one or more of the wells. One or more computer-readable storage media can include processor-executable instructions to instruct a computing system to: implement a control scheme for a plurality of wells; using the control scheme, classify each of the wells using classifications; based on the classifications, identify one or more of the wells as experiencing liquid loading; and issue a control instruction to perform an unloading operation for the one or more of the wells. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

FIG. 10 illustrates an example of a control scheme;

DETAILED DESCRIPTION

The following description includes the best mode presently contemplated for practicing the described implementations. This description is not to be taken in a limiting sense, but rather is made merely for the purpose of describing the general principles of the implementations. The scope of the described implementations should be ascertained with reference to the issued claims.

Figure 1:
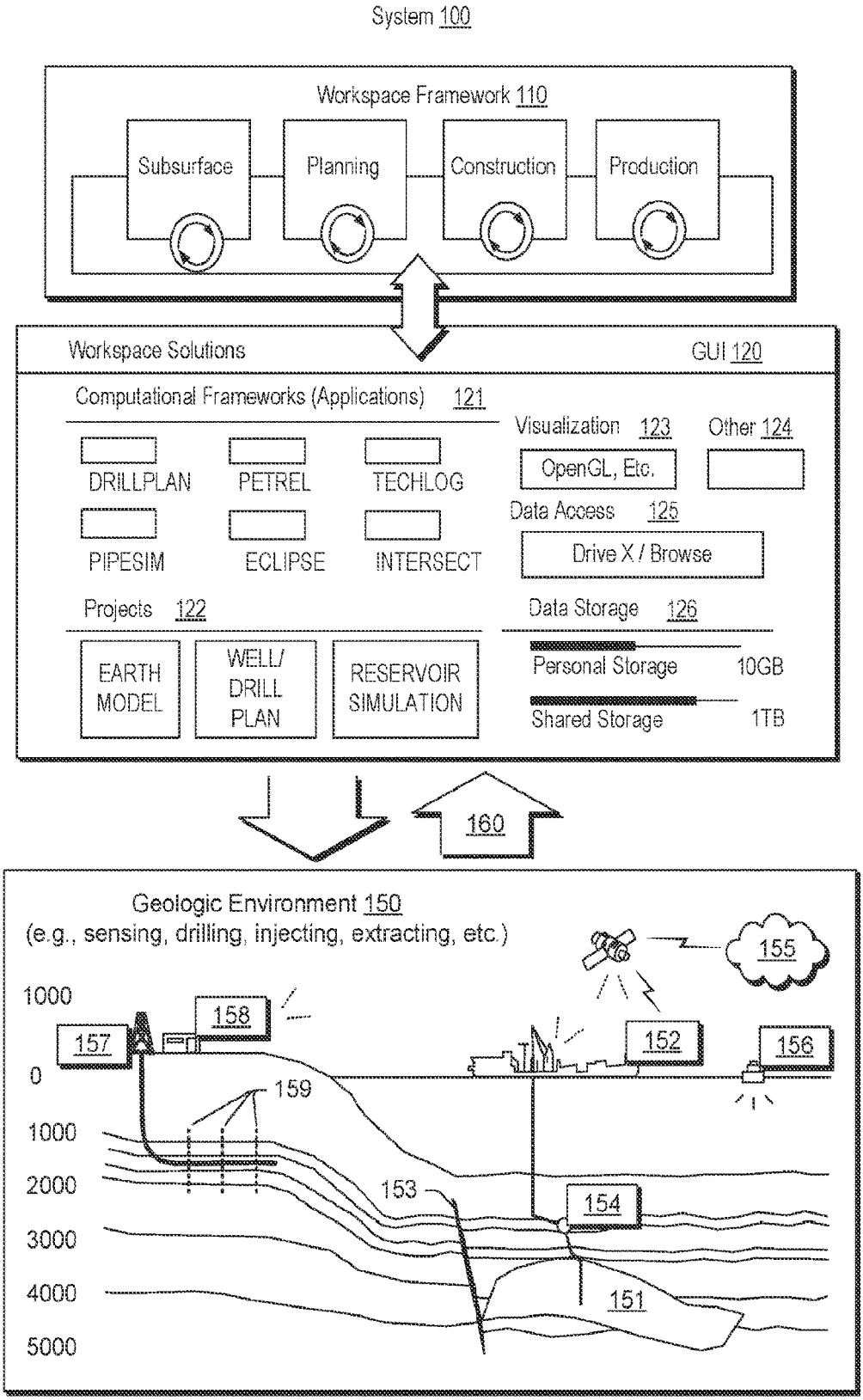
FIG. 1 illustrates an example of a system.

FIG. 1 shows an example of a system 100 that includes a workspace framework 110 that can provide for instantiation of, rendering of, interactions with, etc., a graphical user interface (GUI) 120. In the example of FIG. 1, the GUI 120 can include graphical controls for computational frameworks (e.g., applications) 121, projects 122, visualization 123, one or more other features 124, data access 125, and data storage 126.

In the example of FIG. 1, the workspace framework 110 may be tailored to a particular geologic environment such as an example geologic environment 150. For example, the geologic environment 150 may include layers (e.g., stratification) that include a reservoir 151 and that may be intersected by a fault 153. As an example, the geologic environment 150 may be outfitted with a variety of sensors, detectors, actuators, etc. For example, equipment 152 may include communication circuitry to receive and to transmit information with respect to one or more networks 155. Such information may include information associated with downhole equipment 154, which may be equipment to acquire information, to assist with resource recovery, etc. Other equipment 156 may be located remote from a wellsite and include sensing, detecting, emitting or other circuitry. Such equipment may include storage and communication circuitry to store and to communicate data, instructions, etc. As an example, one or more satellites may be provided for purposes of communications, data acquisition, etc. For example, FIG. 1 shows a satellite in communication with the network 155 that may be configured for communications, noting that the satellite may additionally or alternatively include circuitry for imagery (e.g., spatial, spectral, temporal, radiometric, etc.).

FIG. 1 also shows the geologic environment 150 as optionally including equipment 157 and 158 associated with a well that includes a substantially horizontal portion that may intersect with one or more fractures 159. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop a laterally extensive reservoir (e.g., via fracturing, injecting, extracting, etc.). As an example, the equipment 157 and/or 158 may include components, a system, systems, etc. for fracturing, seismic sensing, analysis of seismic data, assessment of one or more fractures, etc.

In the example of FIG. 1, the GUI 120 shows various features of a computational environment that can include various features of the DELFI environment, which may be referred to as the DELFI framework, which may be a framework of frameworks. As an example, the DELFI framework can include various other frameworks, which can include, for example, one or more types of models (e.g., simulation models, etc.). Some examples of frameworks can include the DRILLPLAN, PETREL, TECHLOG, PIPESIM, ECLIPSE, and INTERSECT frameworks (Schlumberger Limited, Houston, Texas).

The DRILLPLAN framework provides for digital well construction planning and includes features for automation of repetitive tasks and validation workflows, enabling improved quality drilling programs (e.g., digital drilling plans, etc.) to be produced quickly with assured coherency.

The PETREL framework is part of the DELFI cognitive E&P environment (Schlumberger Limited, Houston, Texas) for utilization in geosciences and geoengineering, for example, to analyze subsurface data from exploration, to development, to drilling, to production of fluid from a reservoir.

The TECHLOG framework can handle and process field and laboratory data for a variety of geologic environments (e.g., deepwater exploration, shale, etc.). The TECHLOG framework can structure wellbore data for analyses, planning, etc.

The PIPESIM simulator includes solvers that may provide simulation results such as, for example, multiphase flow results (e.g., from a reservoir to a wellhead and beyond, etc.), flowline and surface facility performance, etc. The PIPESIM simulator may be integrated, for example, with the AVOCET production operations framework (Schlumberger Limited, Houston Texas). As an example, a reservoir or reservoirs may be simulated with respect to one or more enhanced recovery techniques (e.g., consider a thermal process such as steam-assisted gravity drainage (SAGD), etc.). As an example, the PIPESIM simulator may be an optimizer that can optimize one or more operational scenarios at least in part via simulation of physical phenomena.

The ECLIPSE framework provides a reservoir simulator (e.g., as a computational framework) with numerical solutions for fast and accurate prediction of dynamic behavior for various types of reservoirs and development schemes.

The INTERSECT framework provides a high-resolution reservoir simulator for simulation of detailed geological features and quantification of uncertainties, for example, by creating accurate production scenarios and, with the integration of precise models of the surface facilities and field operations, the INTERSECT framework can produce reliable results, which may be continuously updated by real-time data exchanges (e.g., from one or more types of data acquisition equipment in the field that can acquire data during one or more types of field operations, etc.). The INTERSECT framework can provide completion configurations for complex wells where such configurations can be built in the field, can provide detailed chemical-enhanced-oil-recovery (EOR) formulations where such formulations can be implemented in the field, can analyze application of steam injection and other thermal FOR techniques for implementation in the field, advanced production controls in terms of reservoir coupling and flexible field management, and flexibility to script customized solutions for improved modeling and field management control. The INTERSECT framework, as with the other example frameworks, may be utilized as part of the DELFI cognitive E&P environment, for example, for rapid simulation of multiple concurrent cases. For example, a workflow may utilize one or more of the DELFI on demand reservoir simulation features.

The aforementioned DELFI environment provides various features for workflows as to subsurface analysis, planning, construction and production, for example, as illustrated in the workspace framework 110. As shown in FIG. 1, outputs from the workspace framework 110 can be utilized for directing, controlling, etc., one or more processes in the geologic environment 150 and, feedback 160, can be received via one or more interfaces in one or more forms (e.g., acquired data as to operational conditions, equipment conditions, environment conditions, etc.).

As an example, a workflow may progress to a geology and geophysics ("G&G") service provider, which may generate a well trajectory, which may involve execution of one or more G&G software packages.

In the example of FIG. 1, the visualization features 123 may be implemented via the workspace framework 110, for example, to perform tasks as associated with one or more of subsurface regions, planning operations, constructing wells and/or surface fluid networks, and producing from a reservoir.

As an example, visualization features can provide for visualization of various earth models, properties, etc., in one or more dimensions. As an example, visualization features can provide for rendering of information in multiple dimensions, which may optionally include multiple resolution rendering. In such an example, information being rendered may be associated with one or more frameworks and/or one or more data stores. As an example, visualization features may include one or more control features for control of equipment, which can include, for example, field equipment that can perform one or more field operations. As an example, a workflow may utilize one or more frameworks to generate information that can be utilized to control one or more types of field equipment (e.g., drilling equipment, wireline equipment, fracturing equipment, etc.).

As to a reservoir model that may be suitable for utilization by a simulator, consider acquisition of seismic data as acquired via reflection seismology, which finds use in geophysics, for example, to estimate properties of subsurface formations. As an example, reflection seismology may provide seismic data representing waves of elastic energy (e.g., as transmitted by P-waves and S-waves, in a frequency range of approximately 1 Hz to approximately 100 Hz). Seismic data may be processed and interpreted, for example, to understand better composition, fluid content, extent and geometry of subsurface rocks. Such interpretation results can be utilized to plan, simulate, perform, etc., one or more operations for production of fluid from a reservoir (e.g., reservoir rock, etc.).

Field acquisition equipment may be utilized to acquire seismic data, which may be in the form of traces where a trace can include values organized with respect to time and/or depth (e.g., consider 1D, 2D, 3D or 4D seismic data). For example, consider acquisition equipment that acquires digital samples at a rate of one sample per approximately 4 ms. Given a speed of sound in a medium or media, a sample rate may be converted to an approximate distance. For example, the speed of sound in rock may be on the order of around 5 km per second. Thus, a sample time spacing of approximately 4 ms would correspond to a sample "depth" spacing of about 10 meters (e.g., assuming a path length from source to boundary and boundary to sensor). As an example, a trace may be about 4 seconds in duration; thus, for a sampling rate of one sample at about 4 ms intervals, such a trace would include about 1000 samples where later acquired samples correspond to deeper reflection boundaries. If the 4 second trace duration of the foregoing example is divided by two (e.g., to account for reflection), for a vertically aligned source and sensor, a deepest boundary depth may be estimated to be about 10 km (e.g., assuming a speed of sound of about 5 km per second).

As an example, a simulator may utilize various types of constructs, which may be referred to as entities. Entities may include earth entities or geological objects such as wells, surfaces, reservoirs, etc. Entities can include virtual representations of actual physical entities that may be reconstructed for purposes of simulation. Entities may include entities based on data acquired via sensing, observation, etc. (e.g., consider entities based at least in part on seismic data and/or other information). As an example, an entity may be characterized by one or more properties (e.g., a geometrical pillar grid entity of an earth model may be characterized by a porosity property, etc.). Such properties may represent one or more measurements (e.g., acquired data), calculations, etc.

As an example, a simulator may utilize an object-based software framework, which may include entities based on pre-defined classes to facilitate modeling and simulation. As an example, an object class can encapsulate reusable code and associated data structures. Object classes can be used to instantiate object instances for use by a program, script, etc. For example, borehole classes may define objects for representing boreholes based on well data. A model of a basin, a reservoir, etc. may include one or more boreholes where a borehole may be, for example, for measurements, injection, production, etc. As an example, a borehole may be a wellbore of a well, which may be a completed well (e.g., for production of a resource from a reservoir, for injection of material, etc.). While several simulators are illustrated in the example of FIG. 1, one or more other simulators may be utilized, additionally or alternatively.

As mentioned, a framework may be implemented within or in a manner operatively coupled to the DELFI cognitive exploration and production (E&P) environment (Schlumberger, Houston, Texas), which is a secure, cognitive, cloud-based collaborative environment that integrates data and workflows with digital technologies, such as artificial intelligence and machine learning. As an example, such an environment can provide for operations that involve one or more frameworks. The DELFI environment may be referred to as the DELFI framework, which may be a framework of frameworks. As an example, the DELFI framework can include various other frameworks, which can include, for example, one or more types of models (e.g., simulation models, etc.).

Figure 2:
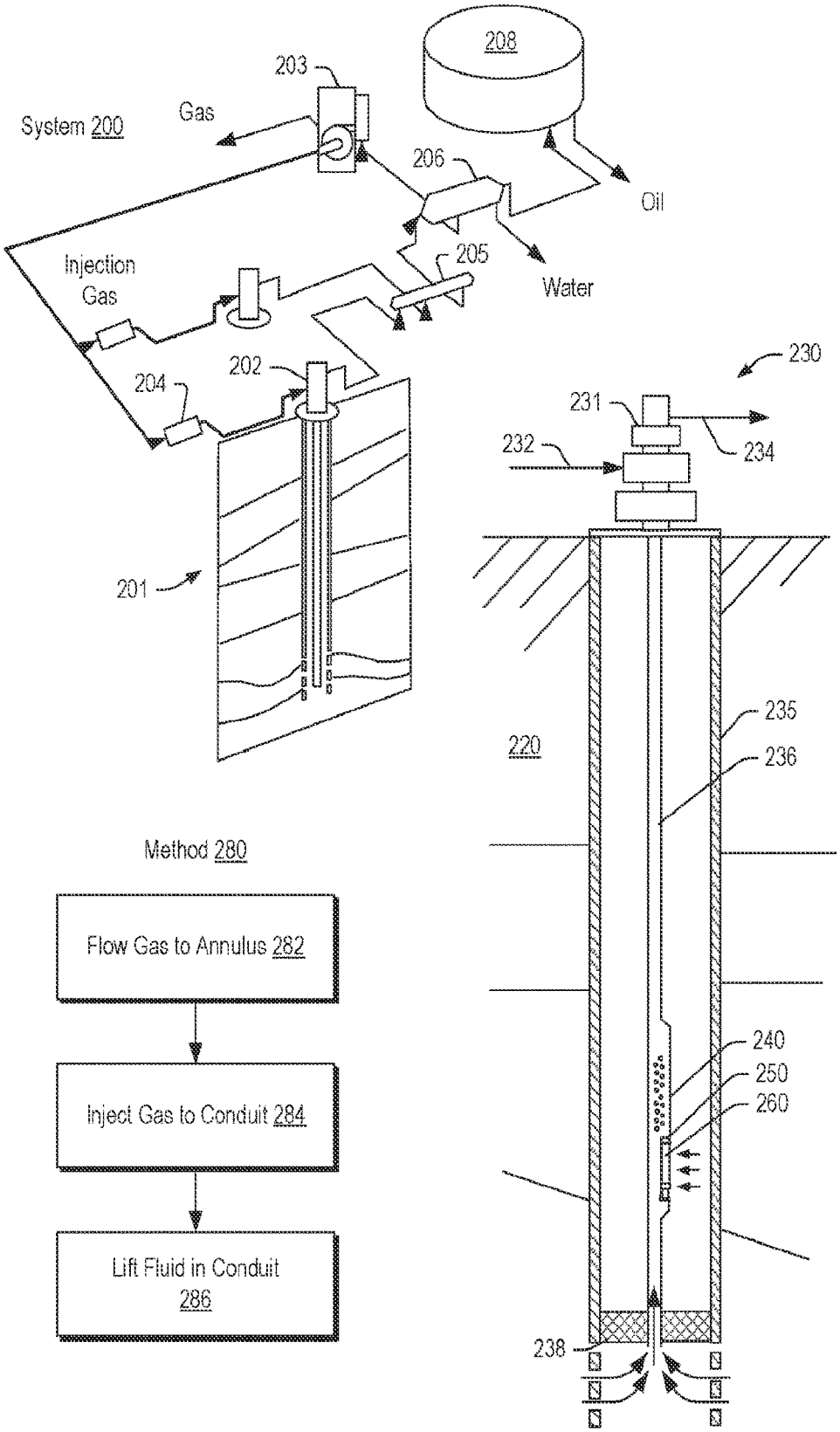
FIG. 2 illustrates an example of a system and an example of a method.

FIG. 2 shows an example of a system 200 that includes various types of equipment. As an example, the system 200 may be planned, modeled, controlled, etc., using one or more features of the system 100 of FIG. 1. For example, consider reservoir modeling where production of fluid, injection of fluid, etc., may be modeled, simulated, etc. As an example, production may decrease with respect to time for one or more wells where an artificial-lift strategy may be implemented to increase, maintain, etc., production, optionally in combination with one or more other strategies (e.g., flooding, treatment, stimulation, fracturing, etc.). As an example, the system 100 may provide estimates as to gas production where such gas may be utilized in one or more artificial-lift operations. As an example, where at least some equipment may scale and/or affect a scaling mechanism, such phenomena may be modeled, simulated, controlled, etc. For example, gas lift equipment may experience scale formation and, for example, may alter one or more of pressure, temperature, chemistry, phase dynamics, etc. A system such as the system 100 of FIG. 1 may provide for combined strategies that aim to optimize artificial lift, which may include one or more strategies as to gas production, scale mitigation, scale treatment, etc.

Gas lift (or gas-lift) is a process where, for example, gas may be injected from an annulus into tubing. An annulus, as applied to an oil well or other well for recovering a subsurface resource may refer to a space, lumen, or void between piping, tubing or casing and the piping, tubing, or casing immediately surrounding it, for example, at a greater radius.

As an example, injected gas may aerate well fluid in production tubing in a manner that "lightens" the well fluid such that the fluid can flow more readily to a surface location. As an example, one or more gas lift valves may be configured to control flow of gas during an intermittent flow or a continuous flow gas lift operation. As an example, a gas lift valve may operate based at least in part on a differential pressure control that can actuate a valve mechanism of the gas lift valve.

As gas lift valve may include a so-called hydrostatic pressure chamber that, for example, may be charged with a desired pressure of gas (e.g., nitrogen, etc.). As an example, an injection-pressure-operated (IPO) gas lift valve or an unloading valve can be configured so that an upper valve in a production string opens before a lower valve in the production string opens.

As an example, a gas lift valve may be configured, for example, in conjunction with a mandrel, for placement and/or retrieval of the gas lift valve using a tool. For example, consider a side pocket mandrel that is shaped to allow for installation of one or more components at least partially in a side pocket or side pockets where a production flow path through the side pocket mandrel may provide for access to a wellbore and completion components located below the side pocket mandrel. As an example, a side pocket mandrel can include a main axis and a pocket axis where the pocket axis is offset a radial distance from the main axis. In such an example, the main axis may be aligned with production tubing, for example, above and/or below the side pocket mandrel.

As an example, a tool may include an axial length from which a portion of the tool may be kicked-over (e.g., to a kicked-over position). In such an example, the tool may include a region that can carry a component such as a gas lift valve. An installation process may include inserting a length of the kickover tool into a side pocket mandrel (e.g., along a main axis) and kicking over a portion of the tool that carries a component toward the side pocket of the mandrel to thereby facilitate installation of the component in the side pocket. A removal process may operate in a similar manner, however, where the portion of the tool is kicked-over to facilitate latching to a component in a side pocket of a side pocket mandrel.

Where gas lift equipment is damaged by scale, one or more remedial operations may be performed; whereas, if left unmitigated, fluid production may decrease and it may be difficult to implement one or more tools (e.g., kickover tool, etc.).

In FIG. 2, the system 200 is shown with an example of a geologic environment 220 that includes equipment and an example of a method 280. The system 200 includes a subterranean formation 201 with a well 202. Injection gas is provided to the well 202 via a compressor 203 and a regulator 204. The injection gas can assist with lifting fluid that flows from the subterranean formation 201 to the well 202. The lifted fluid, including injected gas, may flow to a manifold 205, for example, where fluid from a number of wells may be combined. As shown in the example of FIG. 2, the manifold 205 is operatively coupled to a separator 206, which may separate components of the fluid. For example, the separator 206 may separate oil, water and gas components as substantially separate phases of a multiphase fluid. In such an example, oil may be directed to an oil storage facility 208 while gas may be directed to the compressor 203, for example, for re-injection, storage and/or transport to another location. As an example, water may be directed to a water discharge, a water storage facility, etc.

As shown in FIG. 2, the geologic environment 220 is fitted with well equipment 230, which includes a well-head 231 (e.g., a Christmas tree, etc.), an inlet conduit 232 for flow of compressed gas, an outlet conduit 234 for flow of produced fluid, a casing 235, a production conduit 236, and a packer 238 that forms a seal between the casing 235 and the production conduit 236. As shown, fluid may enter the casing 235 (e.g., via perforations) and then enter a lumen of the production conduit 236, for example, due to a pressure differential between the fluid in the subterranean geologic environment 220 and the lumen of the production conduit 236 at an opening of the production conduit 236. Where the inlet conduit 232 for flow of compressed gas is used to flow gas to the annular space between the casing 235 and the production conduit 236, a mandrel 240 operatively coupled to the production conduit 236 that includes a pocket 250 that seats a gas lift valve 260 that may regulate the introduction of the compressed gas into the lumen of the production conduit 236. In such an example, the compressed gas introduced may facilitate flow of fluid upwardly to the well-head 231 (e.g., opposite a direction of gravity) where the fluid may be directed away from the well-head 231 via the outlet conduit 234.

As shown in FIG. 2, the method 280 can include a flow block 282 for flowing gas to an annulus (e.g., or, more generally, a space exterior to a production conduit fitted with a gas lift valve), an injection block 284 for injecting gas from the annulus into a production conduit via a gas lift valve or gas lift valves and a lift block 286 for lifting fluid in the production conduit due in part to buoyancy imparted by the injected gas.

As an example, where a gas lift valve includes one or more actuators, such actuators may optionally be utilized to control, at least in part, operation of a gas lift valve (e.g., one or more valve members of a gas lift valve). As an example, surface equipment can include one or more control lines that may be operatively coupled to a gas lift valve or gas lift valves, for example, where a gas lift valve may respond to a control signal or signals via the one or more control lines. As an example, surface equipment can include one or more power lines that may be operatively coupled to a gas lift valve or gas lift valves, for example, where a gas lift valve may respond to power delivered via the one or more power lines. As an example, a system can include one or more control lines and one or more power lines where, for example, a line may be a control line, a power line or a control and power line.

As an example, a production process may optionally utilize one or more fluid pumps such as, for example, an electric submersible pump (e.g., consider a centrifugal pump, a rod pump, etc.). As an example, a production process may implement one or more so-called "artificial lift" (or artificial-lift) technologies. An artificial lift technology may operate by adding energy to fluid, for example, to initiate, enhance, etc. production of fluid.

Figure 3:
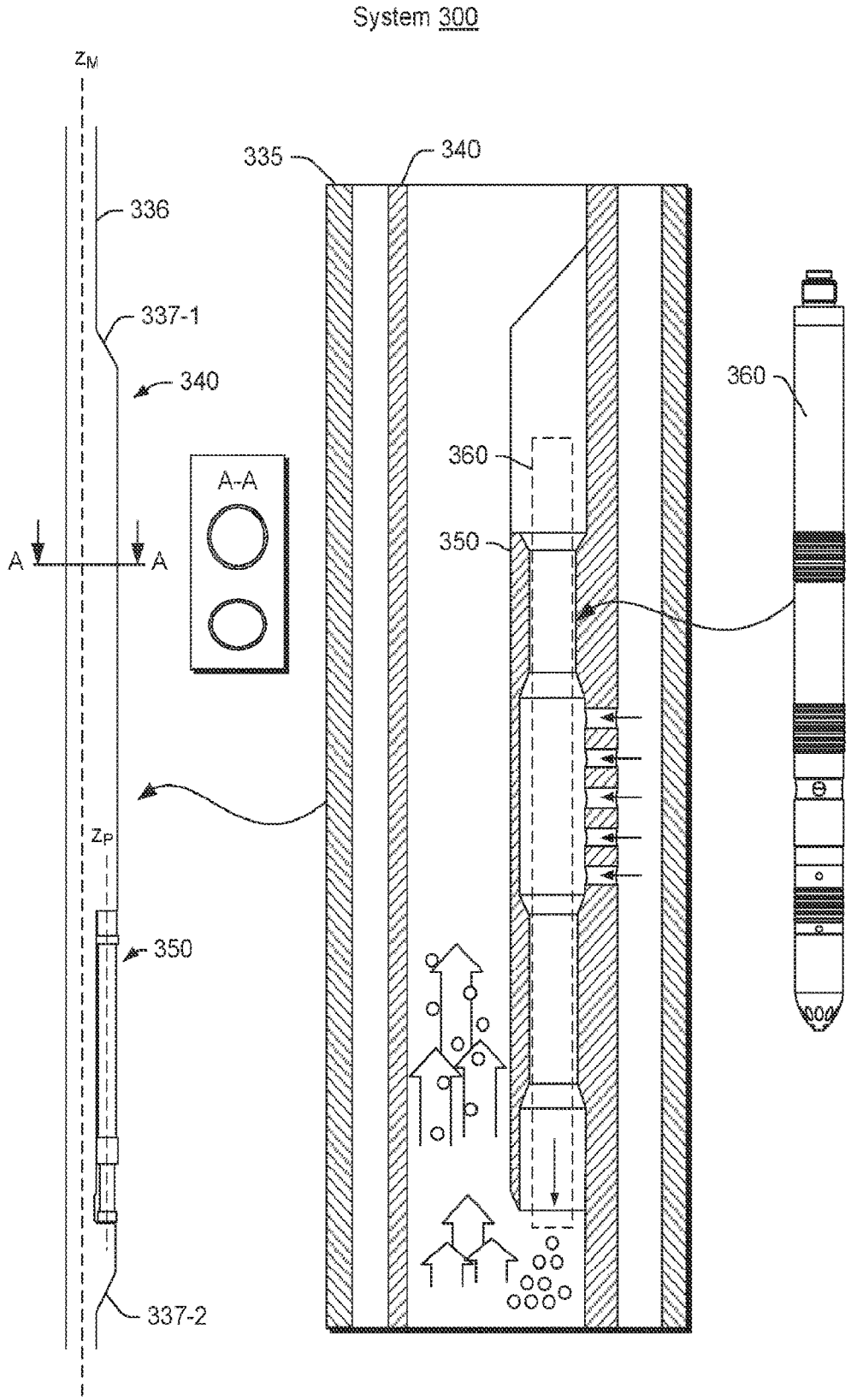
FIG. 3 illustrates an example of a system.

FIG. 3 shows an example of a system 300 that includes a casing 335, a production conduit 336 and a mandrel 340 that includes a pocket 350 that seats a gas lift valve 360. As shown, the mandrel 340 can include a main longitudinal axis ($z_M$) and a side pocket longitudinal axis ($z_P$) that is offset a radial distance from the main longitudinal axis ($z_M$). In the example of FIG. 3, the axes ($z_M$ and $z_P$) are shown as being substantially parallel such that a bore of the pocket 350 is parallel to a lumen of the mandrel 340. Also shown in FIG. 3 are two examples of cross-sectional profiles for the mandrel 340, for example, along a line A-A. As shown, a mandrel may include a circular cross-sectional profile or another shaped profile such as, for example, an oval profile.

As an example, a completion may include multiple instances of the mandrel 340, for example, where each pocket of each instance may include a gas lift valve where, for example, one or more of the gas lift valves may differ in one or more characteristics from one or more other of the gas lift valves (e.g., pressure settings, etc.).

As shown in the example of FIG. 3, the mandrel 340 can include one or more openings that provide for fluid communication with fluid in an annulus (e.g., gas and/or other fluid), defined by an outer surface of the mandrel 340 and an inner surface of the casing 335, via a gas lift valve 360 disposed in the pocket 350. For example, the gas lift valve 360 may be disposed in the pocket 350 where a portion of the gas lift valve 360 is in fluid communication with an annulus (e.g., with casing fluid) and where a portion of the gas lift valve 360 is in fluid communication with a lumen (e.g., with tubing fluid). In such an example, fluid may flow from the annulus to the lumen (e.g., bore) to assist with lift of fluid in the lumen or, for example, fluid may flow from the lumen to the annulus. The pocket 350 may include an opening that may be oriented downhole and one or more openings that may be oriented in a pocket wall, for example, directed radially to a lumen space. As an example, the pocket 350 may include a production conduit lumen side opening (e.g., an axial opening) for placement, retrieval, replacement, adjustment, etc. of a gas lift valve. For example, through use of a tool, the gas lift valve 360 may be accessed. As an example, where a gas lift valve includes circuitry such as a battery or batteries, a tool may optionally provide for charging and/or replacement of a battery or batteries.

In the example of FIG. 3, gas is illustrated as entering from the annulus to the gas lift valve 360 as disposed in the pocket 350. Such gas can exit at a downhole end of the gas lift valve 360 where the gas can assist in lifting fluid in the lumen of the mandrel 340 (e.g., as supplied via a bore of production tubing, etc.).

As an example, a side pocket mandrel may include a circular and/or an oval cross-sectional profile (e.g., or other shaped profile). As an example, a side pocket mandrel may include an exhaust port (e.g., at a downhole end of a side pocket).

As an example, a mandrel may be fit with a gas lift valve that may be, for example, a valve according to one or more specifications such as an injection pressure-operated (IPO) valve specification. As an example, a positive-sealing check valve may be used such as a valve qualified to meet API-19G1 and G2 industry standards and pressure barrier qualifications. For example, with a test pressure rating of about 10,000 psi (e.g., about 69,000 kPa), a valve may form a metal-to-metal barrier between production tubing and a casing annulus that may help to avoid undesired communication (e.g., or reverse flow) and to help mitigate risks associated with gas lift valve check systems.

Figure 4:
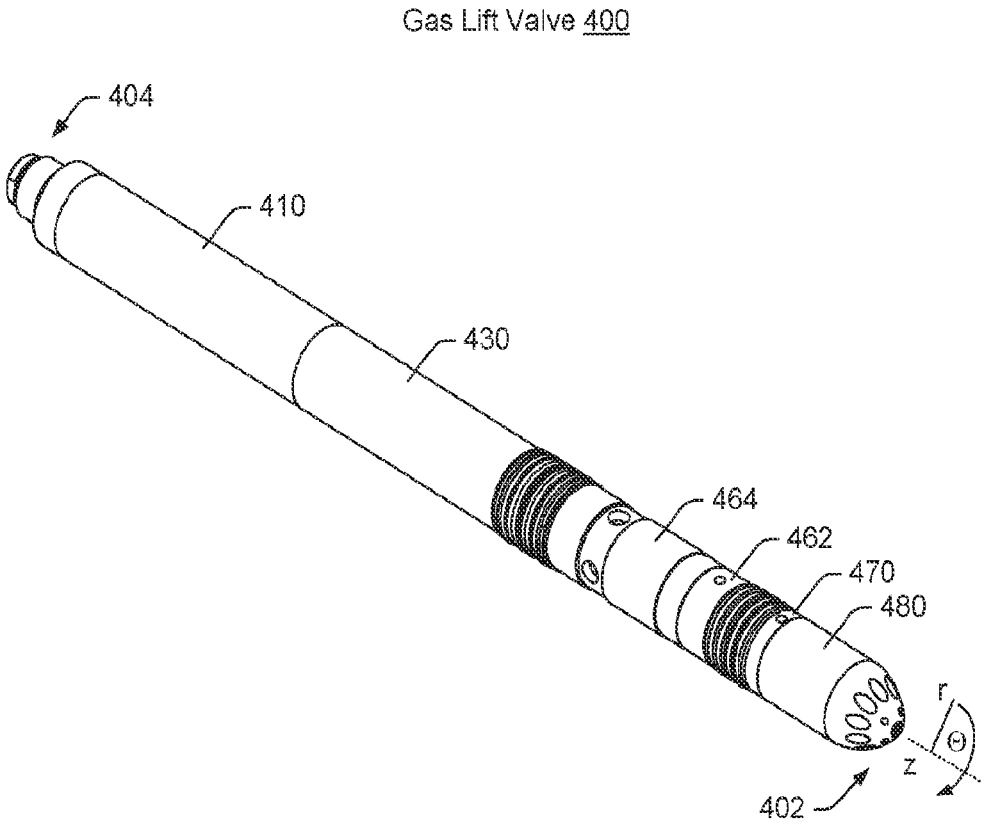
FIG. 4 illustrates an example of a gas lift valve.

FIG. 4 shows an example of a gas lift valve 400 that includes a gas outlet end 402, a tool end 404, a control gas chamber section 410, a bellows valve mechanism section 430, a coupling 462, a gas inlet section 464, a coupling 470 and a gas outlet section 480. Various features of the gas lift valve 400 may be described with respect to a cylindrical coordinate system (e.g., r, z, Θ) where, for example, a z-axis represents a longitudinal axis of the gas lift valve 400, a r-axis represents a distance from the z-axis (e.g., radially outwardly) and an azimuthal angle (Θ) represents an azimuthal position of a feature, for example, with respect to a feature that may be deemed to be at 0 degrees (e.g., a reference feature such as an opening, etc.).

In the example of FIG. 4, the gas lift valve 400 can include a plurality of seal elements, for example, to seal against a bore of a mandrel in which at least a portion of the gas lift valve 400 may be disposed. As an example, a seal element or seal elements may act to form a seal between an outer surface of a gas lift valve and an inner surface of a bore of a mandrel where such a seal may be disposed between a gas inlet opening and a gas outlet opening of the gas lift valve. As an example, seal elements may be ring shaped and, for example, at least in part seated in one or more annular grooves of an outer surface of a gas lift valve. As an example, a gas lift valve can include a plurality of internal seal elements.

Figure 5A:
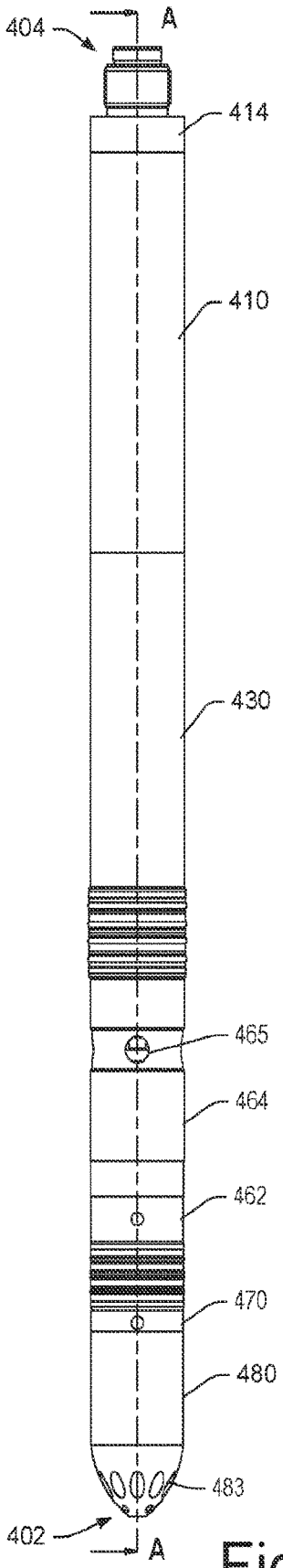
FIGS. 5A and 5B illustrate the gas lift valve of FIG. 4.
Figure 5B:
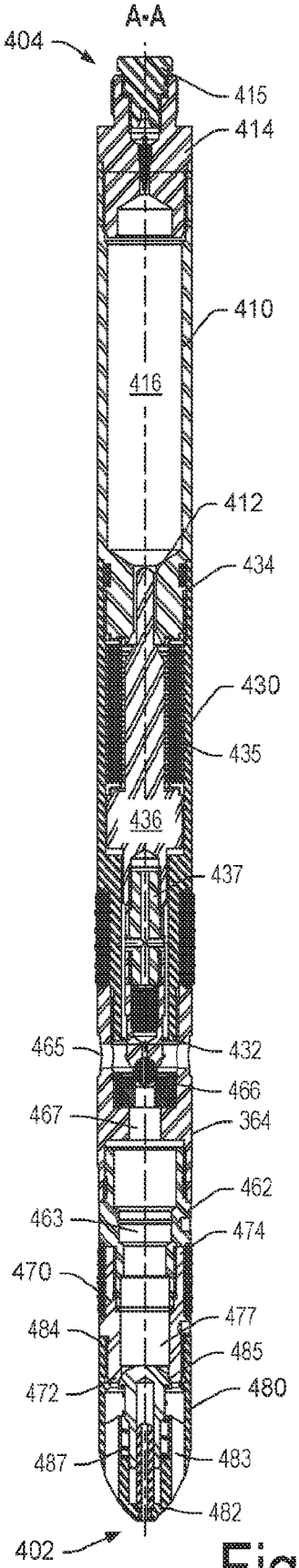

FIG. 5A shows a side view of the gas lift valve 400 and FIG. 5B shows a cutaway view of the gas lift valve 400 along a line A-A. As shown in FIG. 5A, the gas inlet section 464 includes at least one opening 465 as a gas inlet (see, e.g., the arrangement of FIG. 3) and the gas outlet section 480 includes at least one opening 483 as a gas outlet.

FIG. 5B shows the control gas chamber section 410 as including a piston bore 412 and a plug 414 at opposing ends of a gas chamber 416, which may be charged with gas such as nitrogen. In the example of FIG. 5B, a seal plug 415 may be utilized to seal a passage in the plug 414, for example, after charging the gas chamber 416 to a desired gas pressure.

FIG. 5B shows the bellows valve mechanism section 430 as including opposing ends 432 and 434, a bellows 435, a piston 436 and a valve member 437. In the example of FIG. 4B, the bellows 435 may be sealed with respect to the bellows 435 and the chamber 416. In such an example, the one or more openings 465 of the gas inlet section 464 can communicate gas pressure that can act upon the valve member 437. In such an example, where the pressure is sufficiently high (e.g., with respect to pressure in the chamber 416), force exerted may cause the valve member 437 and the piston 436 to translate toward the chamber 416. In such an example, the valve member 437 may retract from a valve seat 466 that is supported by the gas inlet section 464. As shown, the valve seat 466 is annular such that an opening defined thereby can allow for flow of gas to a bore 467 of the gas inlet section 464.

In the example of FIG. 5B, the coupling 462 includes a bore 463 that is in fluid communication with the bore 467 and that is in fluid communication with a bore 477 of the coupling 470 such that gas pressure can act upon a check valve member 485 supported by the gas outlet section 480, which may be seated against an end 472 of the coupling 470, which has an opposing end 474. For example, the check valve member 485 may include a translatable dome shape that can seat against an annular check valve seat defined by the end 472 of the coupling 470.

In the example of FIG. 5B, the check valve member 485 can be biased by a biasing member 487, which may be, for example, a spring. Where gas pressure in the bore 477 of the coupling 470 is sufficiently high, force acting on the check valve member 485 may cause compression of the biasing member 487 and translation of the check valve member 485 downwardly away from the gas inlet section 464 such that the one or more openings 465 of the gas inlet section 464 become in fluid communication with the one or more openings 483 of the gas outlet section 480.

As an example, the check valve member 485 may be referred to as a dart. As an example, the check valve member 485 may be considered to be a low-pressure valve member; whereas the valve member 437 may be considered to be a high-pressure valve member. As an example, a valve member can include a ball that can be seated in a valve seat to plug an opening in the valve seat.

As explained, fluid can flow in various types of equipment, which may include one or more fluid passages, which may range in a cross-section dimension from 0.1 cm to 30 cm (e.g., consider a diameter of 0.1 cm to a diameter of 30 cm). Scale formation in a fluid passage can be detrimental to one or more operations, which may include equipment operation (e.g., gas lift valve, etc.) to production operation (e.g., production of hydrocarbons, etc.). Scale buildup can render equipment inoperable and costly to remediate or remove. As mentioned, scale building in side-pocket mandrel can be detrimental, where scale formed may diminish cross-section of a passage (e.g., a tool passage, a fluid passage, etc.). In various instances, one or more operations may be performed that aim to mitigate scale, treat scale, etc.

As an example, a robust method for gas lift optimization can effectively optimize a system of wells using a real-time data-driven approach where such a method may be model-free. A patent application having Serial No. PCT/US2022/042843, filed on 8 Sep. 2022, is incorporated by reference herein.

Figure 6:
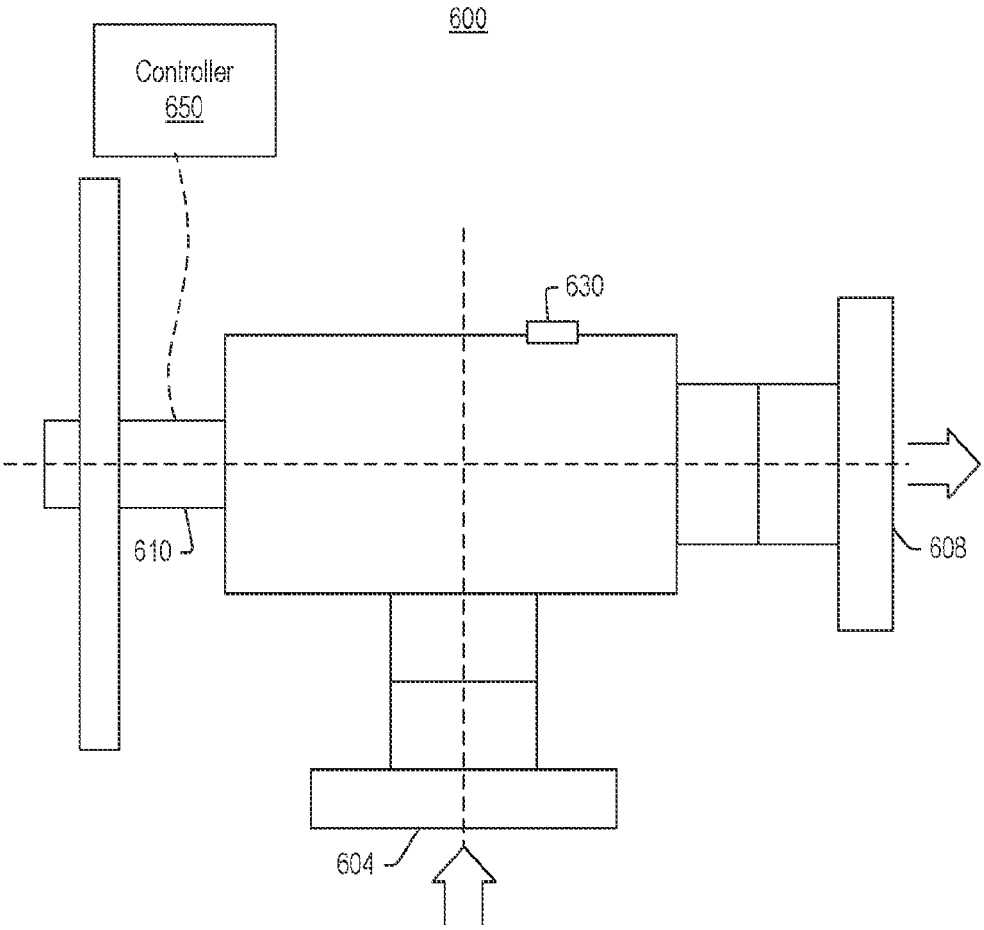
FIG. 6 illustrates an example of a flow device.

FIG. 6 shows an example of a choke valve 600. One or more choke valves can be included in a system (see, e.g., the system 200 of FIG. 2). A choke valve can be located on or near a Christmas tree that is used to control the production of fluid from a well. Opening or closing of a choke valve can influence rate and pressure at which production fluids progress through a pipeline, a process facility, etc. An adjustable choke valve (e.g., an adjustable choke) may be linked to an automated control system to enable one or more production parameters of a well to be controlled.

In the example of FIG. 6, the choke valve 600 includes openings 604 and 608 to corresponding passages where the passages 604 and 608 can be in fluid communication via adjustment of a stem 610, which may be operatively coupled to one or more types of mechanisms. For example, consider a plug and cage mechanism, a needle and seat mechanism, etc.

A plug and cage choke valve can include a plug that is operatively coupled to a stem to move the plug with respect to a cage, which may be a multi-component cage (e.g., consider an inner cage, an outer cage, etc.). In such an example, the cage can include a plurality of openings, which may be of one or more sizes. For example, consider a ring of smaller openings and a ring of larger openings where the different size openings may provide for finer adjustments to flow. In such an example, the plug may first provide for opening of the smaller openings to provide for fluid communication between passages and then, upon further axial translation, provide for opening of the larger openings to provide for more cross-sectional flow area for fluid communication between the passages. As an example, a stem of a plug and cage choke valve can be rotatable where rotation causes axial translation to position the plug with respect to the cage.

A needle and seat choke valve can include a needle portion that can be part of a stem or otherwise operatively coupled to a stem where the stem can be threaded such that rotation causes translation of the needle portion with respect to the seat. When the needle portion is initially translated an axial distance, an annulus is created that causes passages to be in fluid communication. Upon further translation, the needle portion may be completely removed from a bore of the seat such that the annular opening becomes a cylindrical opening, which provides for greater cross-sectional flow area for fluid communication between the passages.

As an example, a choke valve may include one or more sensors that can provide for one or more measurements such as, for example, one or more of position (e.g., stem, needle portion, plug, etc.), flow, pressure, temperature, etc.

As an example, a choke valve may be a unidirectional valve that is intended to be operated with flow in a predefined direction (e.g., from a high-pressure side to a lower pressure side).

A choke valve may be selected such that fluctuations in line pressure downstream of the choke valve have minimal effect on production rate. In operation, flow through a choke valve may be at so-called critical flow conditions. Under critical flow conditions, the flow rate is a function of upstream pressure or tubing pressure. For example, consider a criterion where downstream pressure is to be approximately 0.55 or less of tubing pressure.

As an example, a multiphase choke equation may be utilized to estimate the flowing wellhead pressure for a given set of well conditions along with suitable multiphase choke coefficients (e.g., Gilbert, Ros, Baxendell, Achong, etc.), which may include a number of coefficients (e.g., $A_1$, $A_2$ and $A_3$). For example, consider the following equation with parameter values inserted, as explained below.

$$p_{wh} = \left(3.86\times10^{-3}(400)(800)^{0.546}\right)/\left((12/64)^{1.89}\right) = 1,405\ psia$$

In the foregoing equation, which may be used to estimate flow rate or choke diameter, the well is producing 400 STB/D of oil with a gas-liquid ratio of 800 Scf/STB where the choke size is 12/64 inch and the Gilbert coefficients are $3.86\times10^{-3}$, 0.546 and 1.89, respectively. As indicated, the estimated flowing wellhead pressure is 1,405 psia. In an example using the Ros choke equation, an estimated flowing wellhead pressure of 1,371 psia is calculated.

Parameters that can be utilized in various computations include discharge coefficient (Cd), pipe diameter (d), pipe length (L), specific heat capacity ratio (k) (e.g., Cp/Cv), standard pressure (psc), wellhead pressure (pwh), gas flow rate (qg), liquid flow rate (ql), standard temperature (Tsc), wellhead temperature (Twh), ratio of downstream pressure to upstream pressure (y), gas compressibility factor (z), gas specific gravity (yg), etc.

In the example of FIG. 6, the choke valve 600 includes a port 630 that may be utilized for monitoring pressure. As shown in FIG. 6, a controller 650 may be utilized to control the stem 610. For example, consider a motor that can be operatively coupled to the stem 610 such that the motor can be controlled to adjust the stem 610 (e.g., to adjust the shape and size of the opening or openings between the passages 604 and 608, etc.).

Figure 7:
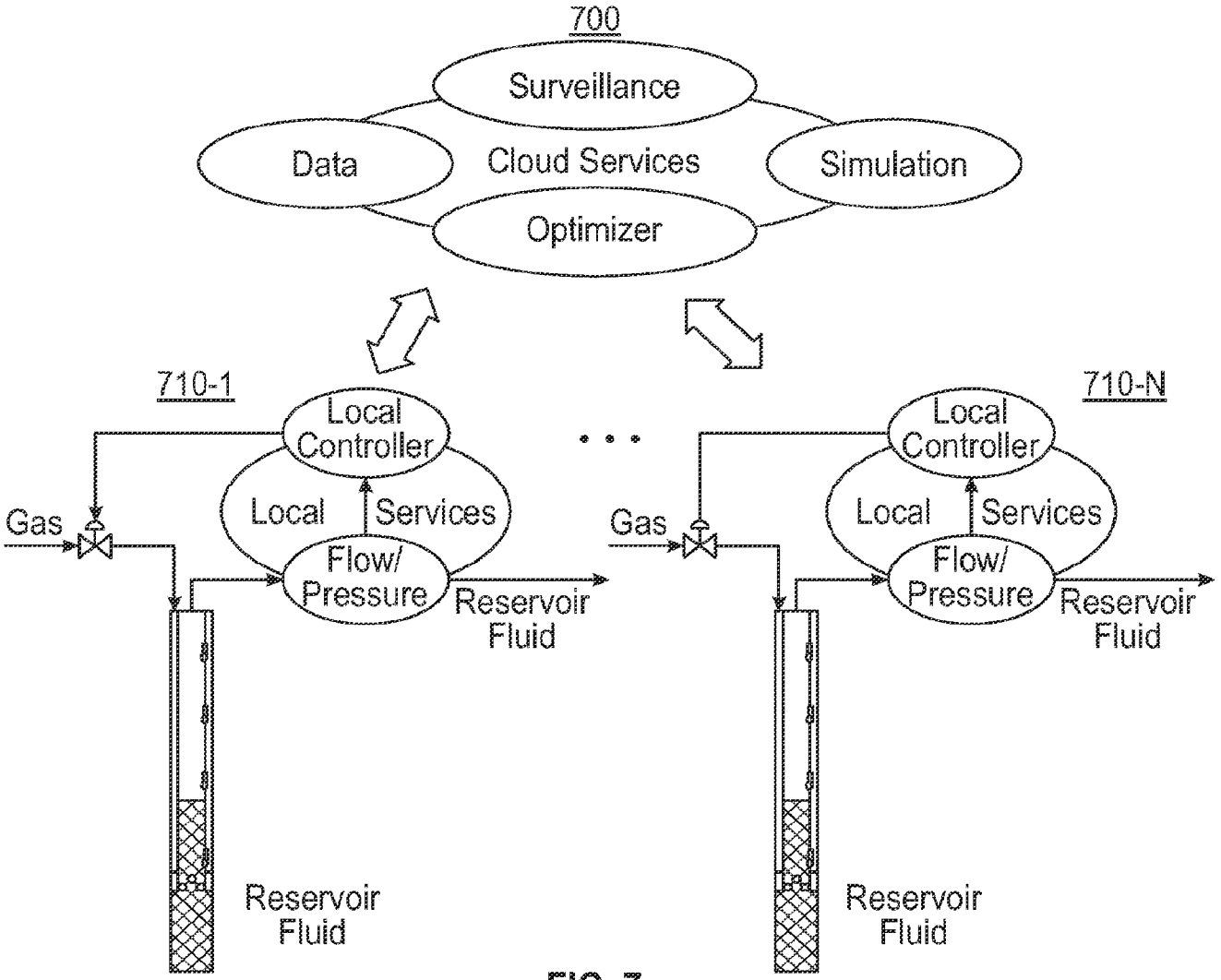
FIG. 7 illustrates an example of a system.
Figure 7:
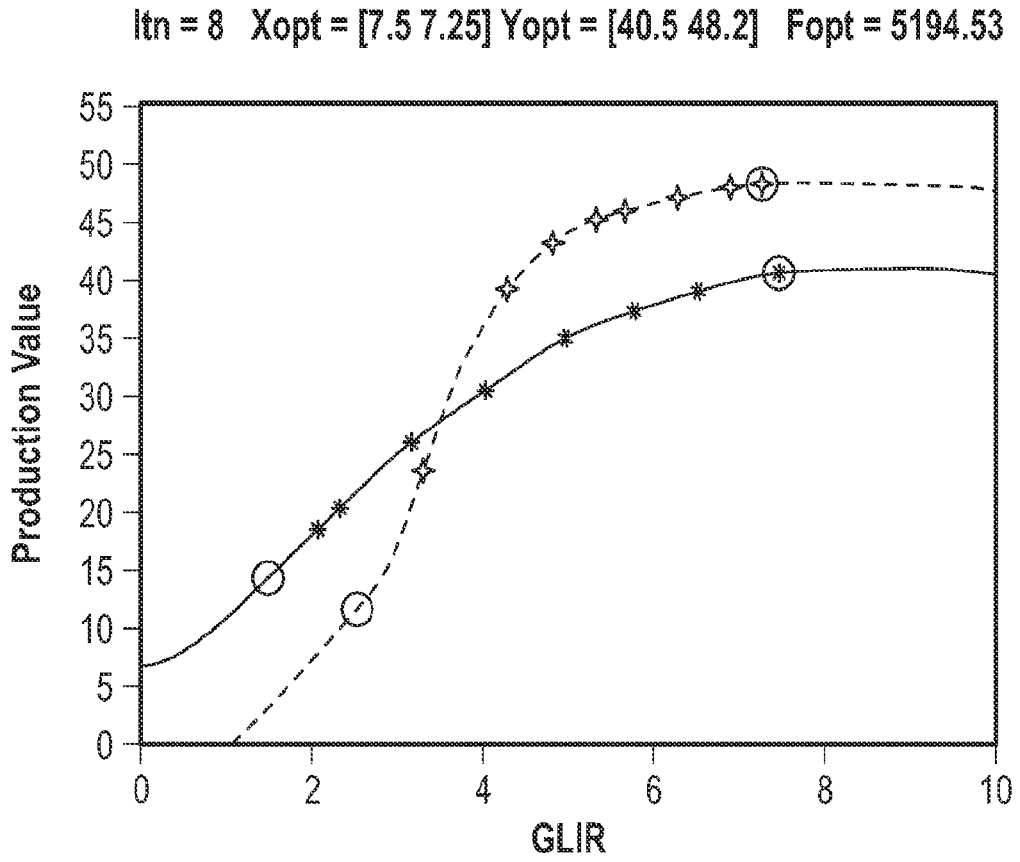

FIG. 7 shows an example of a system 700 with a series of wells 710-1 to 710-N that can be subjected to gas lift, for example, to promote production of reservoir fluid. In such an example, the system 700 may provide for production optimization, for example, via appropriate control of one or more gas lift and/or production parameters.

In the example of FIG. 7, cloud services may be utilized for performing various tasks where the cloud services can be in communication with local services at the wellsites of the wells. As an example, various features may be local and/or remote. For example, some features illustrated with respect to the cloud service may be provided locally, where resources, techniques, technologies, etc., are available.

As an example, the system 700 can provide for various types of simulation such as, for example, reservoir simulation, wellbore simulation, surface network simulation, integrated simulation, etc. As an example, the wellsites can include sensors that can acquire measurements where such measurements may be utilized locally and/or remotely. For example, consider measurements that can be obtained for derived flow rate, proxy models, simulation models, etc.

As an example, the system 700 can provide for automated continuous gas lift optimization subject to constraints. For example, consider a system where one or more cloud-enabled applications can utilize real-time flow meter information to construct well lift models, perform field-wide optimal lift gas allocation (e.g., honoring resource(s) and capacity constraints, provide cloud-hosted service(s) for local well-site control, etc.

As an example, the system 700 can provide for implementing a control scheme to reduce demand for unloading a liquid loaded well or wells. For example, such a control scheme may be tiered (e.g., with sub-schemes) where control is implemented according to states where some states act to minimize operational time under conditions where liquid loading may lead to demand for intervention by manual unloading, which can be a labor intensive and time-consuming operation. For example, consider one or more tailored states that may be intermediate a steady state and an unloading state. In such an example, the unloading state may provide for one or more actions as to self-unloading, which may be performed prior to a call for intervention via manual unloading.

As an example, the system 700 can include and/or utilize features of one or more cloud platforms (e.g., GOOGLE CLOUD, AMAZON WEB SERVICES CLOUD, AZURE CLOUD, etc.). As an example, the DELFI cognitive exploration and production (E&P) environment may be implemented at least in part in a cloud platform that includes one or more features of the system 700.

As explained, choke valves (e.g., chokes) can be present in various field installations such as, for example, at wellsites to control a well. Where a downhole pump is present such as, for example, an electric submersible pump (ESP), the pump may provide features for flow control such that a choke valve is not necessary for flow control.

As explained, a choke valve can be defined via a flow parameter such as cross-sectional area of a constriction region (e.g., a "choke"), which may be represented by a diameter (e.g., an actual diameter or an effective diameter). In a choke valve, flow is expected to pass through the choke such that a choke valve can control production of fluid.

As an example, the following equation may be utilized for flow:

$$Q = a * \frac{P1^b * (P1 - P2)^c * d^2}{GLR^e}$$

In the equation above, P1 and P2 can be real time pressure measurement values, d is a diameter of a choke, and GLR is a gas to liquid ratio (e.g., an oil ratio if the water cut (WC) is zero). The various parameters a, b, c and e can be determined and set, which may characterize behavior of a choke. For example, a change to one or more of the parameters can provide a signature for a particular choke.

The foregoing equation provides for estimating flow (e.g., flow rate) through a choke valve, which can provide for optimization of injection and for increasing production from a well. As an example, an equation such as the foregoing equation may be utilized in a simulation. For example, consider receiving trending data (e.g., real time data) and outputting flow rates. In such an example, as time progresses, the output can reflect (e.g., simulate) the performance of a physical flow meter (e.g., a Vx flow meter, etc.). In such an example, a "virtual" flow meter may be a software-based flow meter that can provide flow information using measurements such as pressure measurements.

As an example, a system can provide for automating a real time process for determining one or more relationships between injection and production for gas lift operations (e.g., gas lift as an artificial lift technology, etc.). As an example, an iterative approach may be utilized in real time to automate finding a relationship between injection and production.

As an example, a system can operate with or without input (e.g., ongoing input, full-time presence of, etc.) from a physical flow meter (e.g., a Vx flow meter, etc.). As an example, a field site can include pressure gauges. For example, consider pressure gauges that can provide pressure measurements P1 and P2. In such an example, the pressure gauges can be electronic and provide for output of signals indicative of measured pressures. As an example, a system may utilize flow information derived from pressure measurements (e.g., a virtual flow meter of VFM), which may be utilized alternatively or additionally with flow information from a physical flow meter.

Figure 8:
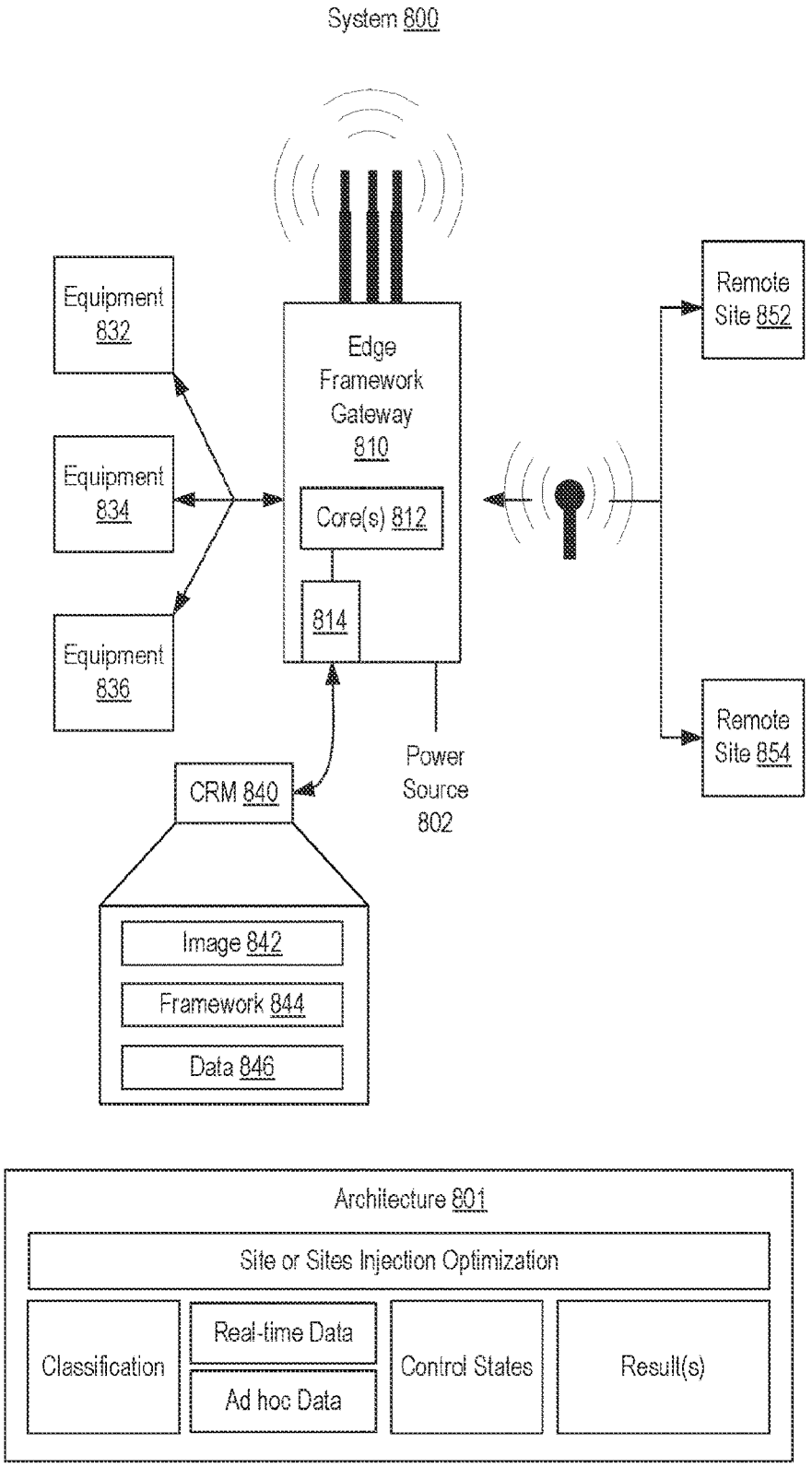
FIG. 8 illustrates an example of a system.

FIG. 8 shows an example of a system 800 and an example of an architecture 801. As shown, the architecture 801 can provide for one or more workflows as to a site or sites. For example, consider a reduction in unloading workflow that can reduce various unloading burdens where liquid loading may be an issue. As an example, a workflow may be for injection optimization, which can be via one or more virtual flow meters (VFMs, choke VFMs, etc.). As an example, the architecture 801 can generate one or more results (e.g., behavior characterizations, classifications, control actions, etc.) that can be utilized for operation at one or more sites. In such an example, the result or results may be generated locally and/or remotely (e.g., depending on number of sites, resources, etc.). As shown, the architecture 801 can include one or more classification components, one or more control states components (e.g., for control decision making), etc. The architecture 801 may include one or more physics models, one or more machine learning models, etc. As shown, the architecture 801 includes an interface for real time data, optionally an interface for ad hoc data, etc. The result(s) component may include a result interface where an output result can be a notification, an alarm, a control trigger, a control instruction, etc., that can call for an action or actions by a piece or pieces of equipment.

As shown, the system 800 can include a power source 802 (e.g., solar, generator, grid, etc.) that can provide power to an edge framework gateway 810 that can include one or more computing cores 812 and one or more media interfaces 814 that can, for example, receive a computer-readable medium 840 that may include one or more data structures such as an image 842, a framework 844 and data 846. In such an example, the image 842 may be an operating system image that can cause one or more of the one or more cores 812 to establish an operating system environment that is suitable for execution of one or more applications. For example, the framework 844 may be an application suitable for execution in an established operating system in the edge framework gateway 810. As an example, the framework 844 may be suitable for performing tasks associated with the architecture 801.

In the example of FIG. 8, the edge framework gateway 810 ("EF") can include one or more types of interfaces suitable for receipt and/or transmission of information. For example, consider one or more wireless interfaces that may provide for local communications at a site such as to one or more pieces of local equipment 832, 834 and 836 and/or remote communications to one or more remote sites 852 and 854. As an example, the local equipment 832, 834 and 836 can include one or more pressure gauges.

As an example, the EF 810 may be installed at a site that is some distance from a city, a town, etc. In such an example, the EF 810 may be accessible via a satellite communication network.

A communications satellite is an artificial satellite that relays and amplifies radio telecommunication signals via a transponder. A satellite communication network can include one or more communication satellites that may, for example, provide for one or more communication channels. As of 2021, there are about 2,000 communications satellites in Earth orbit, some of which are geostationary above the equator such that a satellite dish antenna of a ground station can be aimed permanently at a satellite rather than tracking the satellite.

High frequency radio waves used for telecommunications links travel by line-of-sight, which may be obstructed by the curve of the Earth. Communications satellites can relay a signal around the curve of the Earth allowing communication between widely separated geographical points. Communications satellites can use one or more frequencies (e.g., radio, microwave, etc.), where bands may be regulated and allocated.

Satellite communication tends to be slower and more costly than other types of electronic communication due to factors such as distance, equipment, deployment and maintenance. For wellsites that do not have other forms of communication, satellite communication can be limiting in one or more aspects. For example, where a controller is to operate in real-time or near real-time, a cloud-based approach to control may introduce too much latency. As shown in the example of FIG. 8, the EF 810 may be deployed where it can operate locally with one or more pieces of equipment 832, 834, 836, etc., which may be for purposes of control.

As desired, from time to time, communication may occur between the EF 810 and one or more remote sites 852, 854, etc., which may be via satellite communication where latency and costs are tolerable. As an example, the CRM 840 may be a removable drive that can be brought to a site via one or more modes of transport. For example, consider an air drop, a human via helicopter, plane or boat, etc.

As to an air drop, consider dropping an electronic device that can be activated locally once on the ground or while being suspended by a parachute en route to ground. Such an electronic device may communicate via a local communication system such as, for example, a local WiFi, BLUETOOTH, cellular, etc., communication system. In such an example, one or more data structures may be transferred from the electronic device (e.g., as including a CRM) to the EF 810. Such an approach can provide for local control where one or more humans may or may not be present at the site. As an example, an autonomous and/or human controllable vehicle at a site may help to locate an electronic device and help to download its payload to an EF such as the EF 810. For example, consider a local drone or land vehicle that can locate an air dropped electronic device and retrieve it and transfer one or more data structures from the electronic device to an EF, directly and/or indirectly. In such an example, the drone or land vehicle may establish communication with and/or read data from the electronic device such that data can be communicated (e.g., transferred to one or more EFs).

As to drones, consider a drone that includes one or more features of one or more of the following types of drones DJI Matrice 210 RTK, DJI Matrice 600 PRO, Elistair Orion Tethered Drone, Freefly ALTA 8, GT Aeronautics GT380, Skydio 2, Sensefly eBee X, Skyfront Perimeter 8, Vantage Robotics Snap, Viper Vantage and Yuneec H920 Plus Tornado. The DJI Matrice 210 RTK can have a takeoff weight of 6.2 g (include battery and max 1.2 kg payload), a maximum airspeed of 13-30 m/s (30-70 mph), a range of 500 m-1 km with standard radio/video though it may be integrated with other systems for further range from base, a flight time of 15-30 minutes (e.g., depending on battery and payload choices, etc.). As an example, a gateway may be a mobile gateway that includes one or more features of a drone and/or that can be a payload of a drone.

As an example, a system may include and/or provide access to various resources that may be part of an environment such as, for example, the DELFI environment (see, e.g., FIG. 1). For example, consider the PIPESIM framework, which may be implemented locally and/or remotely (e.g., as a full and/or as a tailored framework). As an example, the PIPESIM framework and/or other framework may be utilized for one or more purposes, which may include calibration, generation of results, etc. As an example, a framework such as the PIPESIM framework may provide for comparisons between output of a semi-empirical model or models and output of the PIPESIM framework.

As an example, an EF may include a license server, a semi-empirical model(s) component, a framework simulation engine (e.g., a PIPESIM engine, etc.) and a REST API where the REST API can receive one or more API calls, for example, as one or more model requests, calibration requests, simulation requests, etc. As an example, an EF may respond to an API call with output where such output may be provided to one or more edge applications, pieces of equipment, etc. (e.g., for individual and/or coordinated control of one or more sets of equipment, etc.).

Referring again to the architecture 801, as explained, one or more physics-based models can be deployed to an edge for implementation, for example, to operate responsive to real-time data, responsive to historical data, etc. As an example, a fluid simulation framework such as the PIPESIM framework may be implemented in an edge manner. Such a fluid simulation framework can be a multiphase flow simulation framework suitable for handling multiphase flow that may occur in one or more types of oil and/or gas field operations.

As shown in FIG. 8, an EF may execute within a gateway such as, for example, an AGORA gateway (e.g., consider one or more processors, memory, etc., which may be deployed as a "box" that can be locally powered and that can communicate locally with other equipment via one or more interfaces). As an example, a gateway can include one or more features of an AGORA gateway (e.g., v.202, v.402, etc.) and/or another gateway. For example, consider an INTEL ATOM E3930 or E3950 Dual Core with DRAM and an eMMC and/or SSD. Such a gateway may include a trusted platform module (TPM), which can provide for secure and measured boot support (e.g., via hashes, etc.). A gateway may include one or more interfaces (e.g., Ethernet, RS485/422, RS232, etc.). As to power, a gateway may consume less than about 100 W (e.g., consider less than 10 W or less than 20 W). As an example, a gateway may include an operating system (e.g., consider LINUX DEBIAN LTS). As an example, a gateway may include a cellular interface (e.g., 4G LTE with Global Modem/GPS, etc.). As an example, a gateway may include a WIFI interface (e.g., 802.11 a/b/g/n). As an example, a gateway may be operable using AC 100-240 V, 50/60 Hz or 24 VDC. As to dimensions, consider a gateway that has a protective box with dimensions of approximately 10 in×8 in×4 in.

As an example, a gateway may be part of a drone. For example, consider a mobile gateway that can take off and land where it may land to operatively couple with equipment to thereby provide for control of such equipment. In such an example, the equipment may include a landing pad. For example, a drone may be directed to a landing pad where it can interact with equipment to control the equipment. As an example, a wellhead can include a landing pad where the wellhead can include one or more sensors (e.g., temperature and pressure) and where a mobile gateway can include features for generating fluid flow values using information from the one or more sensors. In such an example, the mobile gateway may issue one or more control instructions (e.g., to a choke valve, a pump, etc.).

As an example, a gateway may include hardware (e.g. circuitry) that can provide for operation of a drone. As an example, a gateway may be a drone controller and a controller for other equipment where the drone controller can position the gateway (e.g., via drone flight features, etc.) such that the gateway can control the other equipment.

As mentioned, a method can provide for management of liquid loaded wells. As explained above, water cut (WC) can be a parameter that characterizes fluid of a well. WC can be defined as the ratio of water produced compared to the volume of total liquids produced.

In general, liquid that enters a wellbore at a bottom of a hole can flow to a surface if the difference in pressure between the bottom and the top of the well is greater than the hydrostatic pressure of the fluid column, plus any friction that occurs as a result of flow up the tubing. If the pressure is not sufficient, the fluid will remain static in the wellbore, which can be referred to as liquid loading. If gas is primarily being produced, water flowing from the formation, or condensed within the tubing, can also accumulate in the wellbore if the gas is not flowing at sufficient velocity to lift the water from the well. Accumulation of this static fluid column can impose an additional backpressure on the formation that can significantly reduce the productivity of the well or can actually "kill" the well so that it does not flow at all.

When liquid loading occurs, manual intervention can be demanded, for example, to change the wellbore configuration and/or to install artificial lift equipment. In various instances, where artificial lift is already implemented, control, adjustment, etc., to artificial lift may be warranted. As an example, a manual intervention may involve changing the size of the tubing as size affects the velocity of the fluid flowing up a well. If smaller tubing is used, the velocity of the fluid will be greater because of the smaller cross-sectional area. The so-called Turner correlation can help to determine the minimum flow rate (and thus, velocity) required to lift liquids continuously from a gas well. Turner's correlation can be used to determine the size tubing required to remove water continuously from a well that is flowing at a specific rate.

In oil or gas wells that make large volumes of water or condensate, installation of artificial lift equipment to pump the liquids to the surface may be called for such as, for example, one or more of rod pumps, submersible pumps, and gas lift valves.

Liquid loading can be defined as an accumulation of water, gas condensate or both in tubing that can impair gas production and, if not diagnosed in a timely manner, can kill a well. A cause of liquid loading can be a low gas flow rate or gas velocity. For example, if gas velocity drops below the critical velocity required to carry liquid to the surface, liquid can start accumulating in the down-hole of a vertical well, lateral section of the horizontal well and/or in hydraulic fractures.

As an example, gas wells can produce wet gas—that is, natural gas carrying condensate and/or liquid water in the form of mist flow. In such an example, as the gas flow velocity in the well decreases because of reservoir pressure depletion, the carrying capacity of the gas also decreases. When the gas velocity drops to a critical level, liquids begin to accumulate and can undergo annular flow and slug flow in tubing. Accumulation of liquids (e.g., liquid loading) can increase bottom-hole pressure and further reduces gas production rate. A low-gas production rate can, in turn, cause gas velocity to drop further still. Without intervention, eventually, a well can experience a bubbly flow regime and cease producing.

As explained, in an operating field, production rate from individual wells may be controlled by downhole and/or surface enabled chokes. Choke setting may be manipulated to manage produced fluids coming from a reservoir and production up to the surface. The chokes may be adjusted based on the incumbent conditions, either manually, semi-automatically or automatically (e.g., consider closed-loop actuation control, etc.). Effective choke setting control can dictate efficiency of production from wells and help ensure that the wells are operating at or near the best possible state for extended periods. Such an approach can assist in maximizing production value, while minimizing the cost associated with reduced downtime.

Over time, various wells may become liquid loaded (with water), which can impair production capability of a well. In various instances, if the water is not reduced by automated means, a manual intervention may be demanded, which involves taking a well offline. For example, consider a manual intervention that entails opening a well to atmospheric conditions to flush liquid housed in the column before the well can be brought back online. This manual procedure demands time and cost on the part of the operator and reduces total production capability of the field.

As an example, a method can provide an automated procedure using real-time data to manage a set of wells where one or more of the wells may become liquid loaded over time. In such an example, preprocessing can provide for classification of wells, for example, into a number of classes using historic production data. For example, consider three classes: poor, average or good (e.g., by category). In such an example, good wells are those that have sufficient drive to produce fluids and are not prone to liquid loading (e.g., they are able to operate with little or no control); average wells are somewhat productive but suffer from liquid build up in the column over time, which may be mitigated by a control scheme that reduces the choke setting to build up pressure and then opens the choke to help eliminate the water in the column; and poor wells are those which are hard to produce and suffer severely from liquid loading.

As an example, a control scheme can help mitigate liquid build up for a well at a wellsite (e.g., as may be practical) and then call for undertaking a manual unloading operation for the well at the wellsite if appropriate. Such a control procedure can help to reduce the number of manual unloads and hence the cost to operate the wells. Collectively, such a control scheme can be applied to a set of wells and, for example, be governed by a set of rules that can be applied to each well depending on the state of the well. As an example, state can be defined using categories such as, for example, steady-state or intermittent operation, or one under a well unloading, by the procedure. Such states or categories can be themselves control schemes (e.g. sub-schemes).

As an example, a method can commence by classifying wells by class and applying one or more appropriate control rules. As an example, a well or wells may be re-classified with time according to a change in condition. For example, a good well may become an average well, and an average well may become a poor well. Such a method can be highly scalable across many wells and, for example, be configurable by tuning one or more unit-less parameters (see, e.g., dimensionless groups in FIG. 12) in a rule-based scheme.

Figure 9:
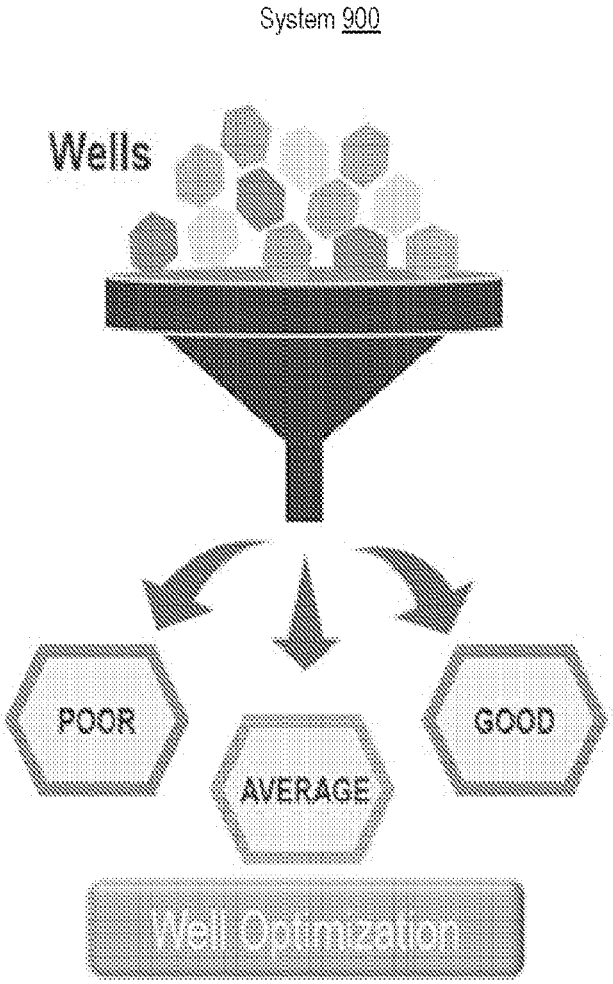
FIG. 9 illustrates an example of a system.

FIG. 9 shows an example of a system 900 that provides for classifying wells into three pre-defined classes: good, average and poor. Such classes can be defined using physical parameters as may be measured by one or more sensors and/or derived from sensor data. As explained, a method may commence by classifying wells, which may be based on historical data. Once such a method moves into control, classifications may be updated, as appropriate, for example, using data acquired during implementation of a control scheme.

FIG. 10 shows an example of a control scheme 1000 that includes states 1010 and 1020 and an unloading operation 1030 (e.g., an unloading state). As explained, such states may be control schemes, which may be referred to as sub-schemes. As shown in FIG. 10, the state 1010 is a steady state (e.g., steady state control scheme), the state 1020 is an intermittent state (e.g., intermittent state control scheme) while the unloading operation 1030 can correspond to an unloading state control scheme.

As explained, a method can help to reduce manual unloads and wellsite visits for controller intervention. Such a method may operate well set-points autonomously, increase or optimize gas production, improve surface operations and efficiency and/or provide for remote update on a controller or controllers.

As to the steady state 1010, as a control scheme, it can be characterized by a maintained constant gas rate, autonomous choke control, maximum liquid drainage and no demand for manual unloads. As to the intermittent state 1020, as a control scheme, it can be characterized by average reservoir support, maximum well production time and minimum time that the well is producing below a critical velocity. As to the unloading operation 1030, as a control scheme, it can be characterized by identifying a well as experiencing liquid loading and transmission/receipt of one or more alarms, self-unloading for short duration cycles and autonomous return of the well to normal operation. As explained, the unloading operation 1030 can include calling for manual intervention to perform manual unloading as may be warranted. In such an example, operation under control of the unloading operation 1030, as a control scheme, can reduce demand for manual intervention and/or reduce time associated with a manual intervention, if called for (e.g., after self-unloading, etc.).

As shown in the example of FIG. 10, each of the states 1010, 1020 and 1030 has associated rules, which provide for various levels of control logic. The rules can be case as "if" statements, which may be provided with conjunctions (e.g., "and", "or", etc.) and/or "else" statements. As shown, resulting control actions can be "shut", "open", "unload=true", "unload=false", "start unload=true", etc. In the state 1010, control actions can include adjustments to gas rate set-point (GR) and/or "shut" and/or "open".

In the example of FIG. 10, the following parameters are listed:

$P_T$=Tubing Pressure
$P_C$=Casing Pressure
$P_L$=Line Pressure
Fcut=Flow Rate Cut Off
$C_{Trigdly}$=Shut off Delay Time
a, b, c, d=steady state flow indicators
e=Open Well indicator
f=Unloading Completion indicator
z=Liquid Loading Onset Indicator
GR=Gas Rate Set-point Operation cycles can depend on the category and state of each well. That is, a good well will be under steady state operation; an average well will be in intermittent operation until unloading is called for, in which it moves to the unloading operation. Once unloading is completed (e.g., via operation of the unloading operation 1030 as a control scheme and/or via actual manual unloading), a well can return to the intermittent operation, which may occur automatically.

The example control scheme 1000 of FIG. 10 can be implemented via digital workflows that permit real-time date gathering, analysis and, for example, control in a closed-loop manner.

As to preprocessing, to categorize wells in the Good, Average and Poor categories, a physics-based approach can be utilized. For example, consider a method that includes solving the following differential equations to characterize wells:

$$-\frac{B_R}{P_R}\frac{dP_R}{dt} = A_1(P_R - P_T) - A_2(P_F - P_R) \tag{1}$$

$B_R$: factor related to reservoir volume
$P_R$: Reservoir pressure
$P_T$: tubular pressure
$P_F$: far-field pressure, constant
$A_1$: Reservoir to wellbore permeability×perforation area/characteristic length (constant for a well)
$A_2$: Far field to reservoir permeability×drainage area characteristic length (constant for a well)

$$B_T\frac{dP_T}{dt} = A_1P_R(P_R - P_T) - A_3(P_T - P_L) \tag{2}$$

where $B_T$: proportional to tubular volume (viscosity×volume/mol wt)
$P_L$: line pressure
$A_3$: constant to account for flow across an orifice As explained, historical data may be utilized to provide classifications for a set of wells prior to implementation of particular controls for each of the classes. As an example, a control scheme can provide for classifying (e.g., as an initial process and/or as an ongoing process).

Figure 11:
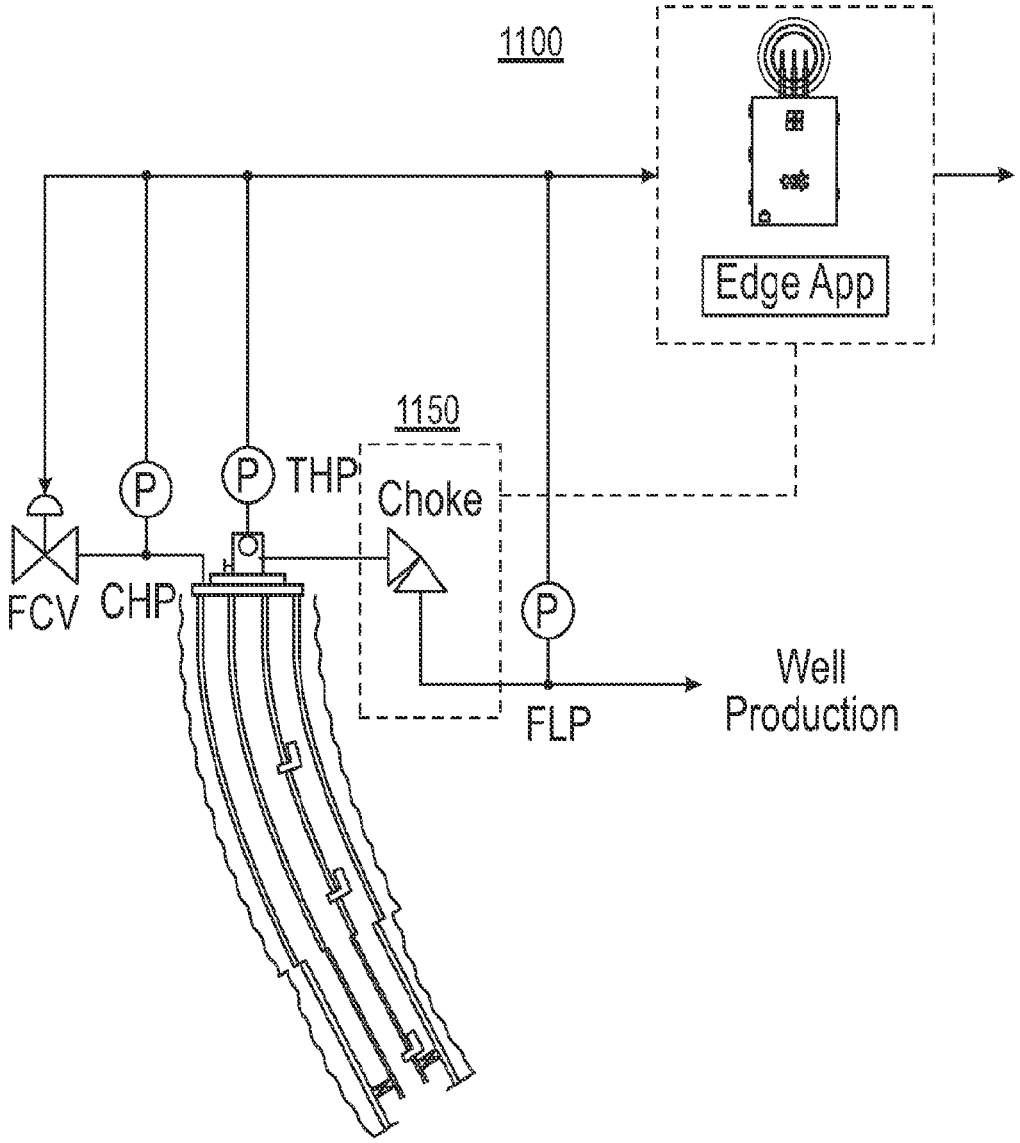
FIG. 11 illustrates an example of a system.
Figure 11:
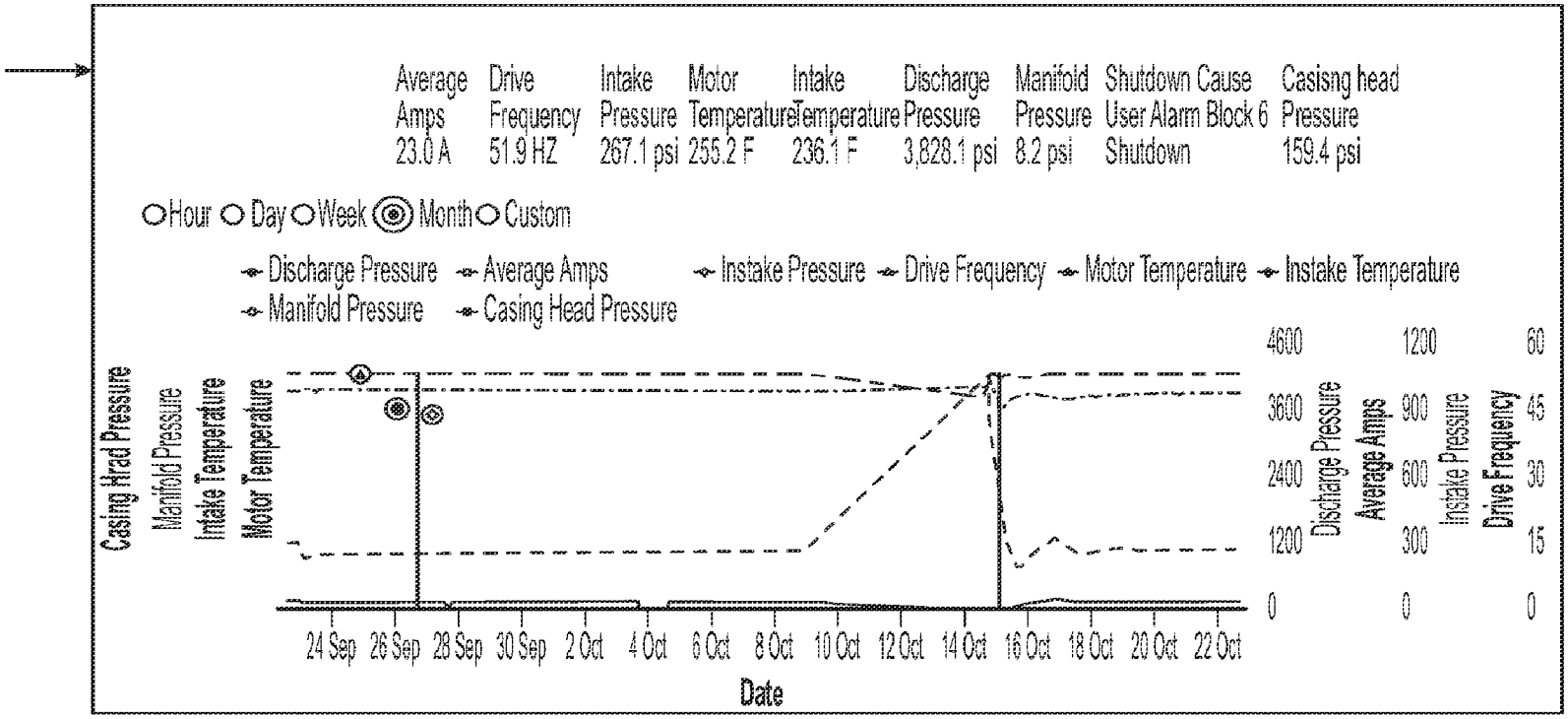
Figure 11:
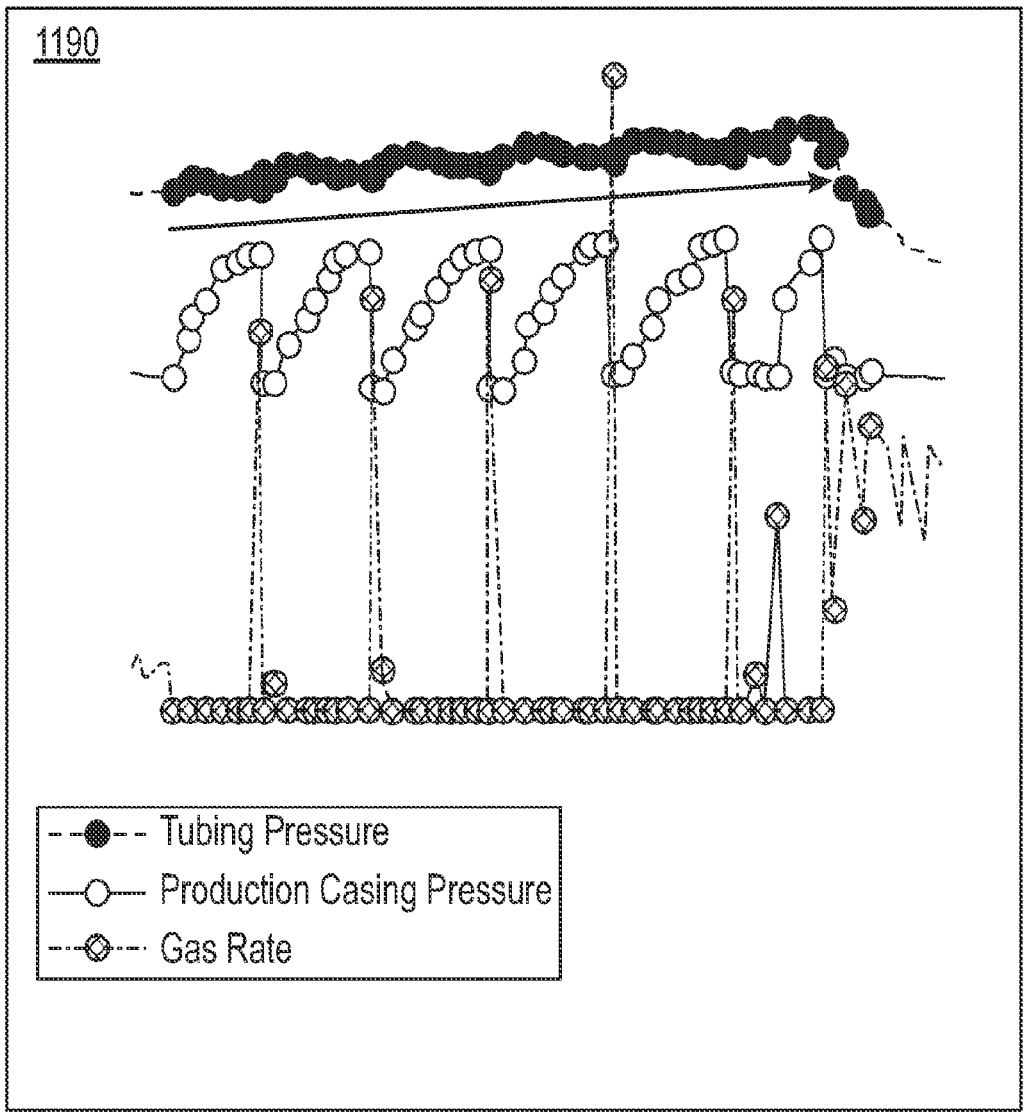

FIG. 11 shows an example of a control system 1100 with a control valve 1150 that can be operatively coupled to an edge application (edge app) along with a plot 1190. As shown, the control system 1100 can operate with respect to a well at a wellsite that includes various types of equipment. As shown, the wellsite can include a flow control valve (FCV) for injection control, a pressure gauge (CHP) for injection pressure, a pressure gauge (THP) at a wellhead for upstream reservoir fluid pressure, a choke valve and a pressure gauge (FLP) for downstream reservoir fluid pressure. As shown, the control valve 1150 can be implemented as part of an edge application executing on a field device (e.g., an edge device, etc.). The control valve 1150 may provide for virtual flow meter operation that can output a rate across a choke, for example, based on measurements from the upstream and downstream pressure gauges. In the example of FIG. 11, the edge application may control one or more pieces of equipment, for example, to control gas lift as an artificial lift enhancement to the well, etc. As explained, such an approach may account for injection at one or more wells. In the example of FIG. 11, a graphical user interface (GUI) is shown that can provide for monitoring and/or control at one or more wellsites.

As explained, a valve can include a choke or constricted region that has a controllable cross-section flow area. As the area decreases, the pressure may decrease, for example, to a pressure of zero if the control valve 1150 is closed. As explained, the control valve 1150 can control flow where, for example, such control may be characterized by an upstream pressure P1 and a downstream pressure P2 and/or a physical flow meter. As an example, a control valve may be a choke valve that can be adjustable, changeable, etc., as to a choke region.

As an example, the system 1100 of FIG. 11 may be operatively coupled to and/or include one or more features for managing liquid loading issues for one or more wells. As an example, such one or more features may make the system 1100, at least in part, a liquid loaded well unloading reduction system. As an example, the control scheme 1000 of FIG. 10 may be implemented using the system 1100.

As to the plot 1190 of FIG. 11, it can be rendered as part of a GUI and can include data such as tubing pressure, production casing pressure and gas rate (GR). The plot 1190 shows data that correspond to unloading cycles to remove water and maintain desired differential. As explained, the unloading operation 1030 of FIG. 10 can include calling for control for self-unloading for short duration cycles. As explained, a control scheme, where appropriate, may call for manual intervention to perform unloading at a wellsite (e.g., where a flow may have stopped, etc.).

Figure 12:
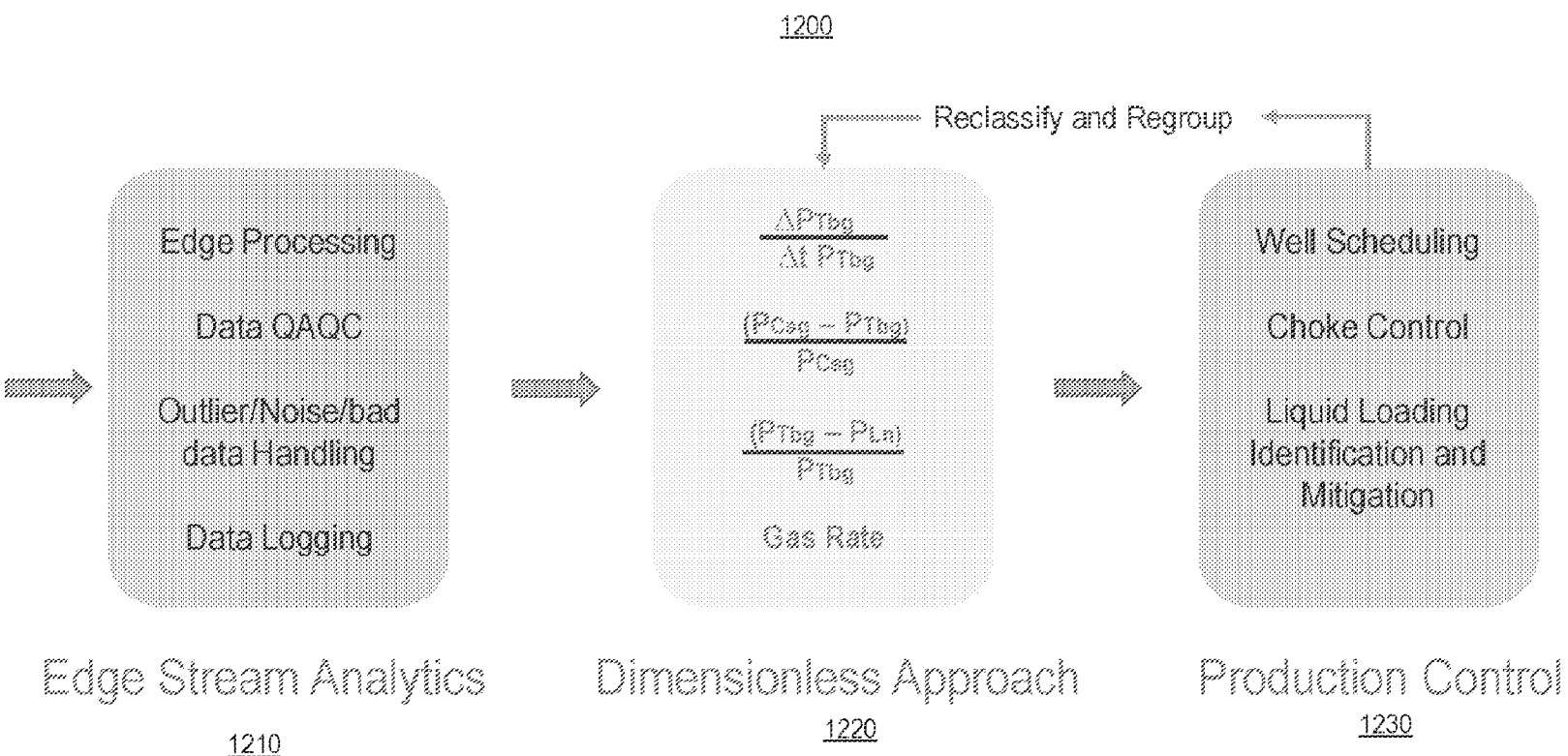
FIG. 12 illustrates an example of a method.

FIG. 12 shows an example of a method 1200 that includes an edge stream analytics block 1210, a dimensionless group computation block 1220 and a production control block 1230. As shown, various gas rates can be cast in a dimensionless manner (e.g., unit-less) where such rates can be utilized for one or more types of production control. As indicated, such control can include one or more of well scheduling, choke control, liquid loading identification and mitigation, etc.

Figure 13:
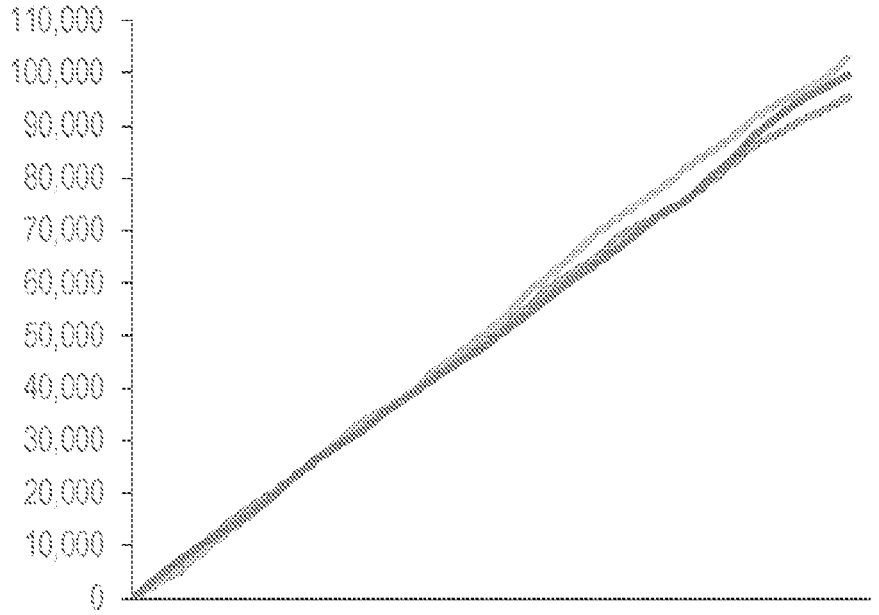
FIG. 13 illustrates an example of a data table and an example of a plot.

FIG. 13 shows an example of a data table 1310 and an example of a plot 1320. As shown in the data table 1310, for two wells, labeled with names 1 and 2, unloading operations were performed in two months (M1 and M2) without implementation of a system that reduces unloading demands. In a third month, labeled "pilot", a system to reduce unloading demands was implemented. As indicated, the number of unloading operations was reduced to zero and a production gain was achieved.

In the plot 1320, cumulative production for a number of wells is shown versus days of a month (e.g., from 0 to 31 days). In the plot 1320, the lowest line (gray) is for a month without implementation of a system to reduce unloading demands whereas the other two lines are for two months where such a system was implemented. As shown, the system was able to arrest production decline.

Figure 14:
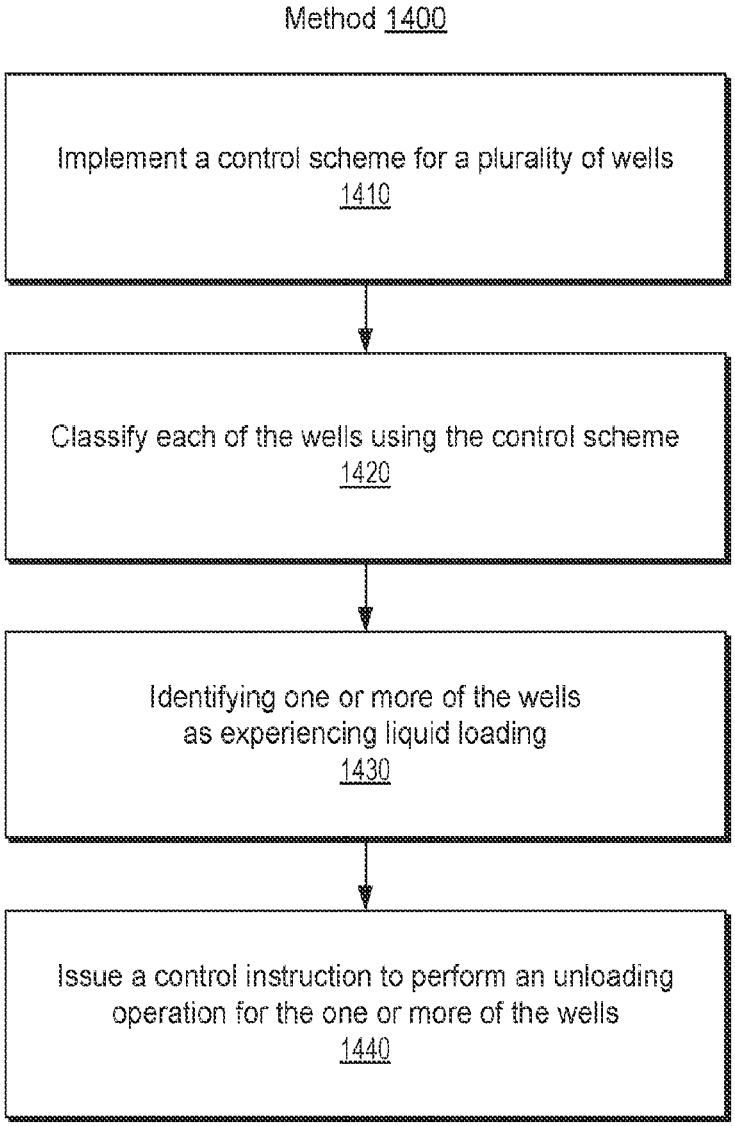
FIG. 14 illustrates an example of a method.

FIG. 14 shows an example of a method 1400 that includes an implementation block 1410 for implementing a control scheme for a plurality of wells; a classification block 1420 for, using the control scheme, classifying each of the wells; based on the classifying, an identification block 1430 for identifying one or more of the wells as experiencing liquid loading; and an issuance block 1450 for issuing a control instruction to perform an unloading operation for the one or more of the wells.

Figure 15:
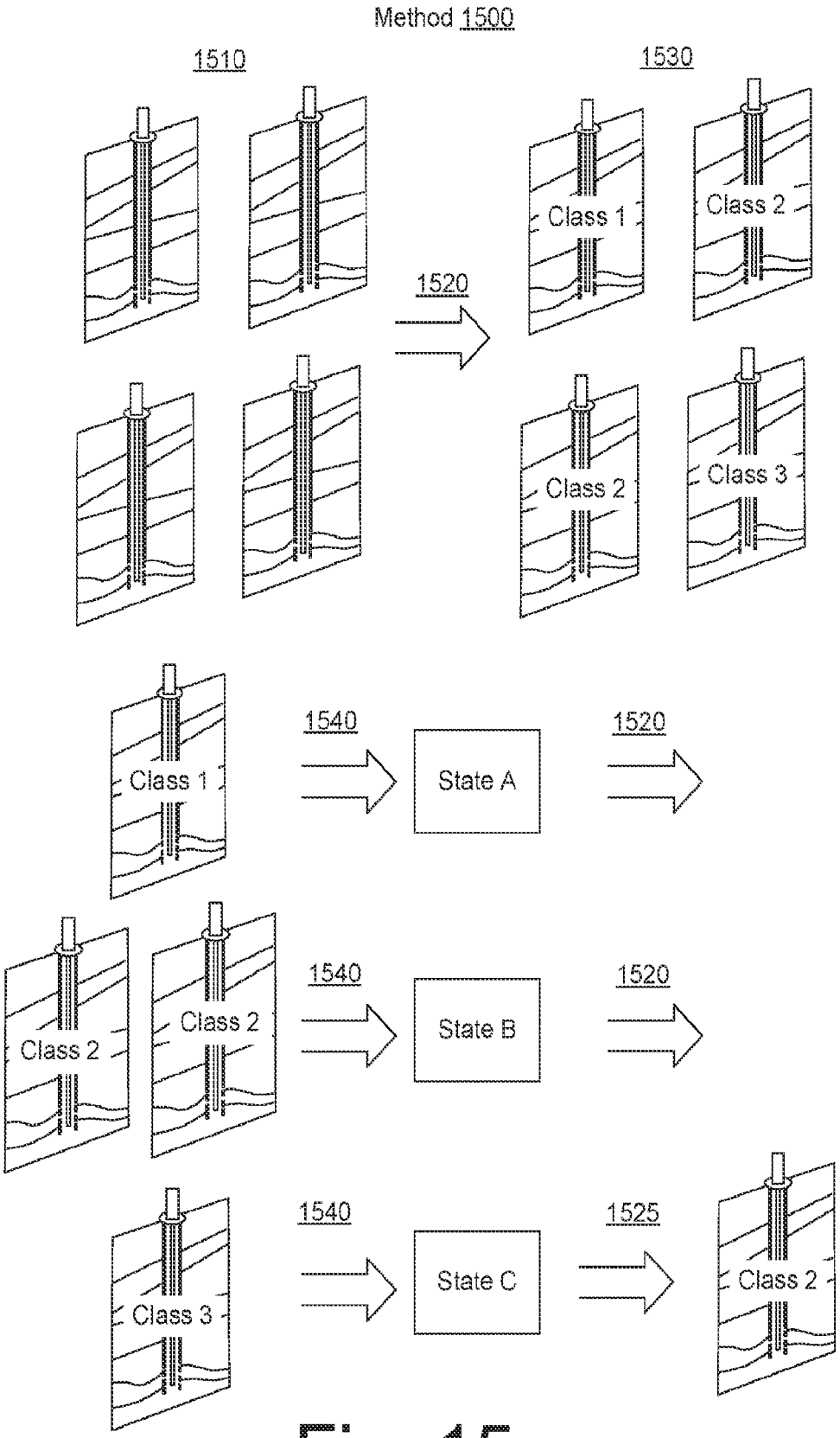
FIG. 15 illustrates an example of a method.

FIG. 15 shows an example of a method 1500 that includes various graphics that represent wells where classification 1520 provides for classifying each of a set of wells 1510 into an appropriate class (e.g., class 1, class 2 or class 3) to provide classified wells 1530. As shown, each of the classified wells 1530 can be controlled according to a control scheme 1540 that includes various control states (e.g., state A, state B and state C). During operation according to the appropriate control state, which can correspond to an appropriate class, each of the wells 1510 may be subject again to the classification 1520; noting, however, an automatic reclassification 1525 can occur, for example, where state C corresponds to an unloading state such that after performing of an unloading operation on a well in class 3, the well is automatically classified as being in class 2 (e.g., a class above class 3 that is not including unloading).

As illustrated and described the method 1500 can be implemented using a closed-loop such that a control scheme with various states operates in a closed-loop mode. As an example, such a control scheme may be autonomously operated where, for example, after intervention (e.g., manual intervention, etc.) for a well that demands unloading, the well, if successfully unloaded, returns to the set of wells for appropriate classification and control.

As explained, a method can reduce demands for unloading. For example, the multi-state approach to controlling wells can include an intermediate state that is between a steady state and an unloading state where such an intermediate state (e.g., an intermittent state) can control operation of a well in manner that can reduce demand for performing an unloading operation for the well.

As explained with respect to FIG. 10, the intermittent state (e.g., an intermediate state) can utilize a control scheme that aims to minimize time that a well is producing below a critical velocity. As indicated, using data-based rules, control operations can include open or shut. Such controlled operational decisions can aim to maximize well production time and as explained, at least in part by minimizing time that a well is producing below a critical velocity. In such an approach, a well may be less likely to be classified in a class that corresponds to an unloading state. As shown in FIG. 10, the unloading state can include various data-based rules that can make control decisions, which can include some amount of self-unloading, where appropriate.

As explained, the intermittent state can utilize a control scheme that reduces a choke setting to build up pressure and then open the choke to help eliminate water in the column; whereas, the unloading state can utilize a control scheme for wells classified as hard to produce (e.g., suffering from substantial liquid loading) where the control scheme aims to mitigate the liquid build up to at least a certain extent and then to call for performance of a manual unloading operation at the wellsite, as appropriate. Where a control-based approach is utilized prior to a call for performing a manual unloading, the manual unloading operation itself may be expedited (e.g., it may be possible to perform it more rapidly, in a lesser amount of time).

As explained, a system may utilize local and/or remote features. As an example, a "smart" valve may include one or more pressure measurement interfaces and/or one or more pressure gauges. In such an example, the smart valve may include processing and memory resources sufficient for using a model and/or calibrating a model where the model can output flow rates based on pressure measurements. As mentioned, a field device may generate an alarm for recalibration of a VFM, which may include calling for performing a well test. As mentioned, a smart flow meter may include a VFM that can be utilized where, for example, one or more features of the smart flow meter may be shut down, not operational, fouled, etc.

Figure 16:
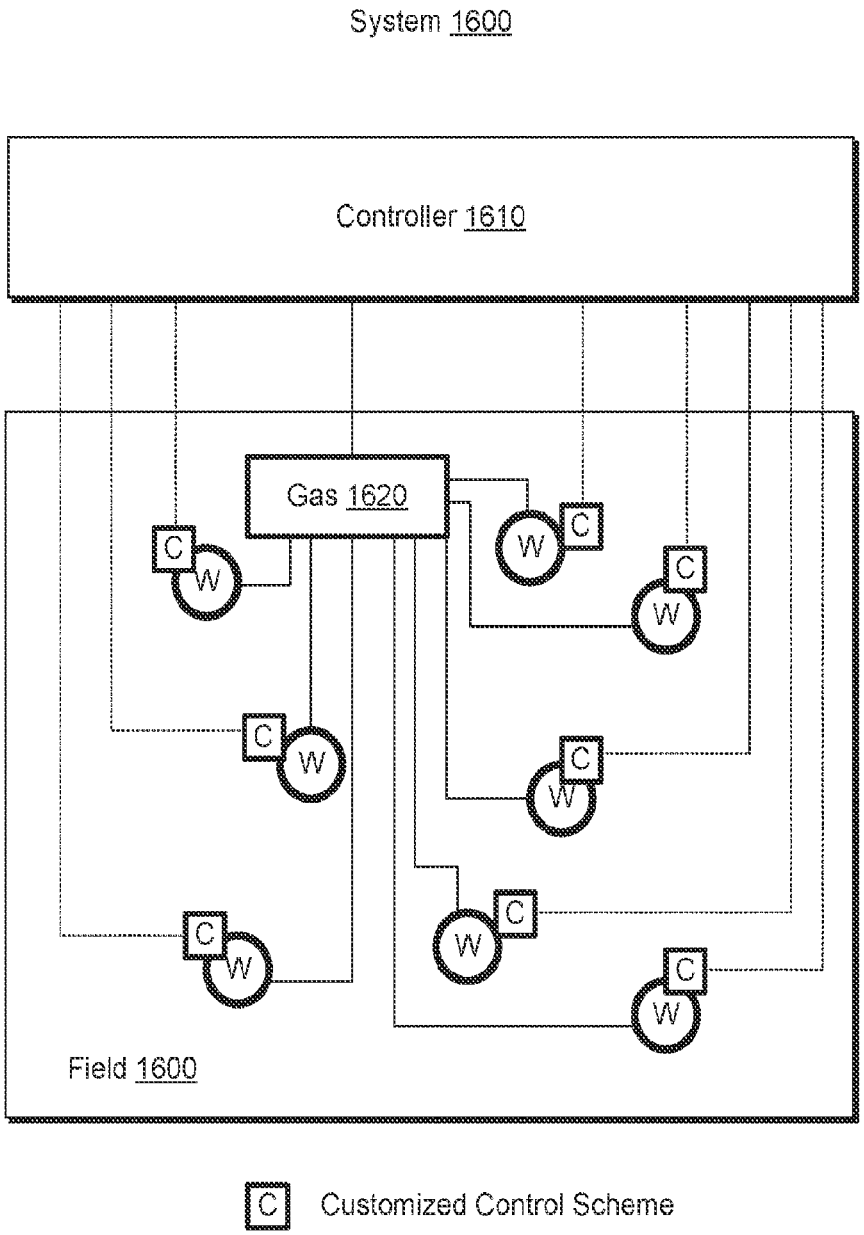
FIG. 16 illustrates an example of a controller.

FIG. 16 shows an example of a system 1600 that includes a controller 1610 that can include a customized control scheme (C) component and that may include a data driven gas lift optimization component 1620. As an example, the controller 1610 can optionally integrate control schemes for one or more purposes, which can include gas lift optimization. As an example, a wired and/or a wireless network may be utilized for control and/or receipt of output.

Figure 17:
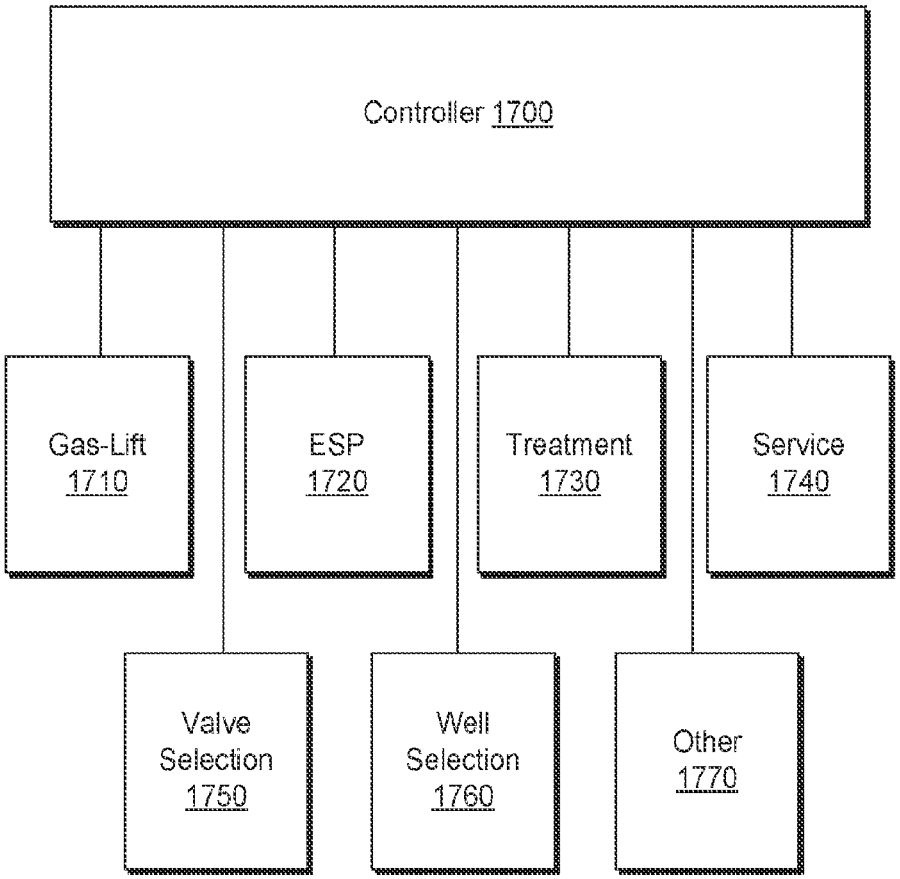
FIG. 17 illustrates an example of a controller.

FIG. 17 shows an example of a controller 1700, which may be implemented as the controller 1610 of FIG. 16. In the example of FIG. 17, the controller 1700 can include one or more components such as, for example, one or more of a gas lift component 1710, an electric submersible pump component 1720, a treatment component 1730, a service component 1740, a valve selection component 1750, a well selection component 1760 and one or more other components 1770. As explained, information gleaned via control such as according to the method 1400 and/or the method 1500 may be utilized to determine one or more actions that may aim to improve production, improve operation of equipment (e.g., valves, etc.), improve utilization of one or more resources (e.g., gas, electricity for an ESP, chemical injection, etc.).

As an example, a method can include analyzing a result for an indication of an issue. For example, consider one or more of a production issue, a valve issue, a gas supply issue, a scaling issue and an energy issue. In such an example, a result may be compared to one or more other wells and/or past results. As an example, a trained machine learning model may be utilized to detect one or more issues. For example, consider a labeled set of regression results, which may be actual, simulated, actual and simulated, etc., that can be utilized to train a machine learning model (e.g., a neural network, etc.). Once trained, a method can include analyzing a regression-based result using the trained machine learning model to detect or predict a likelihood of an issue or issues. As mentioned, an issue may be a scaling issue where scaling of a valve can be mitigated via servicing, chemical treatment, etc. As an example, measurements may be analyzed, for example, with respect to noise or types of noise. For example, scaling or other issues may present certain behavior or noise in measurement data (e.g., sensor data). As an example, a machine learning approach may be utilized to detect one or more issues using one or more types of input.

As to types of machine learning models, consider one or more of a support vector machine (SVM) model, a k-nearest neighbors (KNN) model, an ensemble classifier model, a neural network (NN) model, etc. As an example, a machine learning model can be a deep learning model (e.g., deep Boltzmann machine, deep belief network, convolutional neural network, stacked auto-encoder, etc.), an ensemble model (e.g., random forest, gradient boosting machine, bootstrapped aggregation, AdaBoost, stacked generalization, gradient boosted regression tree, etc.), a neural network model (e.g., radial basis function network, perceptron, back-propagation, Hopfield network, etc.), a regularization model (e.g., ridge regression, least absolute shrinkage and selection operator, elastic net, least angle regression), a rule system model (e.g., cubist, one rule, zero rule, repeated incremental pruning to produce error reduction), a regression model (e.g., linear regression, ordinary least squares regression, stepwise regression, multivariate adaptive regression splines, locally estimated scatterplot smoothing, logistic regression, etc.), a Bayesian model (e.g., naïve Bayes, average on-dependence estimators, Bayesian belief network, Gaussian naïve Bayes, multinomial naïve Bayes, Bayesian network), a decision tree model (e.g., classification and regression tree, iterative dichotomiser 3, C4.5, C5.0, chi-squared automatic interaction detection, decision stump, conditional decision tree, M5), a dimensionality reduction model (e.g., principal component analysis, partial least squares regression, Sammon mapping, multidimensional scaling, projection pursuit, principal component regression, partial least squares discriminant analysis, mixture discriminant analysis, quadratic discriminant analysis, regularized discriminant analysis, flexible discriminant analysis, linear discriminant analysis, etc.), an instance model (e.g., k-nearest neighbor, learning vector quantization, self-organizing map, locally weighted learning, etc.), a clustering model (e.g., k-means, k-medians, expectation maximization, hierarchical clustering, etc.), etc.

As an example, a machine model, which may be a machine learning model, may be built using a computational framework with a library, a toolbox, etc., such as, for example, those of the MATLAB framework (MathWorks, Inc., Natick, Massachusetts). The MATLAB framework includes a toolbox that provides supervised and unsupervised machine learning algorithms, including support vector machines (SVMs), boosted and bagged decision trees, k-nearest neighbor (KNN), k-means, k-medoids, hierarchical clustering, Gaussian mixture models, and hidden Markov models. Another MATLAB framework toolbox is the Deep Learning Toolbox (DLT), which provides a framework for designing and implementing deep neural networks with algorithms, pretrained models, and apps. The DLT provides convolutional neural networks (ConvNets, CNNs) and long short-term memory (LSTM) networks to perform classification and regression on image, time-series, and text data. The DLT includes features to build network architectures such as generative adversarial networks (GANs) and Siamese networks using custom training loops, shared weights, and automatic differentiation. The DLT provides for model exchange various other frameworks.

As an example, the TENSORFLOW framework (Google LLC, Mountain View, CA) may be implemented, which is an open-source software library for dataflow programming that includes a symbolic math library, which can be implemented for machine learning applications that can include neural networks. As an example, the CAFFE framework may be implemented, which is a DL framework developed by Berkeley AI Research (BAIR) (University of California, Berkeley, California). As another example, consider the SCIKIT platform (e.g., scikit-learn), which utilizes the PYTHON programming language. As an example, a framework such as the APOLLO AI framework may be utilized (APOLLO.AI GmbH, Germany). As an example, a framework such as the PYTORCH framework may be utilized (Facebook AI Research Lab (FAIR), Facebook, Inc., Menlo Park, California).

As an example, a training method can include various actions that can operate on a dataset to train a ML model. As an example, a dataset can be split into training data and test data where test data can provide for evaluation. A method can include cross-validation of parameters and best parameters, which can be provided for model training.

The TENSORFLOW framework can run on multiple CPUs and GPUs (with optional CUDA (NVIDIA Corp., Santa Clara, California) and SYCL (The Khronos Group Inc., Beaverton, Oregon) extensions for general-purpose computing on graphics processing units (GPUs)). TENSORFLOW is available on 64-bit LINUX, MACOS (Apple Inc., Cupertino, California), WINDOWS (Microsoft Corp., Redmond, Washington), and mobile computing platforms including ANDROID (Google LLC, Mountain View, California) and IOS (Apple Inc.) operating system based platforms.

TENSORFLOW computations can be expressed as stateful dataflow graphs; noting that the name TENSORFLOW derives from the operations that such neural networks perform on multidimensional data arrays. Such arrays can be referred to as "tensors".

As an example, a method can include implementing a control scheme for a plurality of wells; using the control scheme, classifying each of the wells; based on the classifying, identifying one or more of the wells as experiencing liquid loading; and issuing a control instruction to perform an unloading operation for the one or more of the wells. In such an example, the unloading operation can include a self-unloading operation and/or a manual unloading operation. As an example, consider issuing an instruction for a self-unloading operation and issuing another control instruction to perform a manual unloading operation after the self-unloading operation.

As an example, classifying can include classifying each of the wells into one of at least three classes. As explained, such classifying may commence using historical data and may be undated automatically as appropriate during implementation of a control scheme. As an example, a control scheme can include features for classifying and for implementing particular control schemes (e.g., sub-schemes) based at least in part on such classifying. As an example, a control scheme can operate using real-time data where control decisions are made based at least in part on such data, for example, using rules.

As an example, a classification scheme can include at least three classes that include an intermediate class and where a control scheme can include an intermediate control scheme (e.g., a sub-scheme) that corresponds to the intermediate class and acts to minimize time where velocity is below a critical velocity. As an example, a classification scheme can include an upper class where a control scheme includes a steady state control scheme (e.g. a sub-scheme) that corresponds to the upper class and acts to adjust a gas rate set-point.

As an example, a control scheme can include states that are assigned according to a corresponding class of a classifying process. For example, consider states that include a steady state, an intermittent state and an unloading state. Such state can be rules based and depend on real-time data. As an example, a method may include re-classifying wells in a manner that can depend at least in part on real-time data. For example, a "good" well may become "average" such that a controller transitions its control scheme from a steady state control scheme to an intermittent control scheme.

As an example, a method can include classifying that depends on a physics-based model. For example, consider a physics-based model that includes differential equations that are solved to provide a solution where the solution is implemented to classify each of a plurality of wells (e.g., a set of wells).

As an example, a control scheme can include states defined via rules, which may be or include logic rules. As an example, rules can include rules that depend on sensor-based values where, for example, the sensor-based values include pressure values (e.g., from one or more pressure sensors). As an example, rules can include at least one time-dependent rule and/or at least one conjunction-dependent rule. As an example, a rule may depend on one or more parameters such as, for example, a time (e.g., in minutes, etc.).

As an example, a method can include implementing an autonomous choke control scheme for at least a portion of wells. For example, in FIG. 10, the steady state can include implementation of autonomous choke control.

As an example, a control scheme can be a closed-loop control scheme.

As an example, a system can include a processor; memory accessible to the processor; processor-executable instructions stored in the memory and executable by the processor to instruct the system to: implement a control scheme for a plurality of wells; using the control scheme, classify each of the wells using classifications; based on the classifications, identify one or more of the wells as experiencing liquid loading; and issue a control instruction to perform an unloading operation for the one or more of the wells.

As an example, one or more computer-readable storage media can include processor-executable instructions to instruct a computing system to: implement a control scheme for a plurality of wells; using the control scheme, classify each of the wells using classifications; based on the classifications, identify one or more of the wells as experiencing liquid loading; and issue a control instruction to perform an unloading operation for the one or more of the wells.

As an example, a computer program product can include one or more computer-readable storage media that can include processor-executable instructions to instruct a computing system to perform one or more methods and/or one or more portions of a method.

Figure 18:
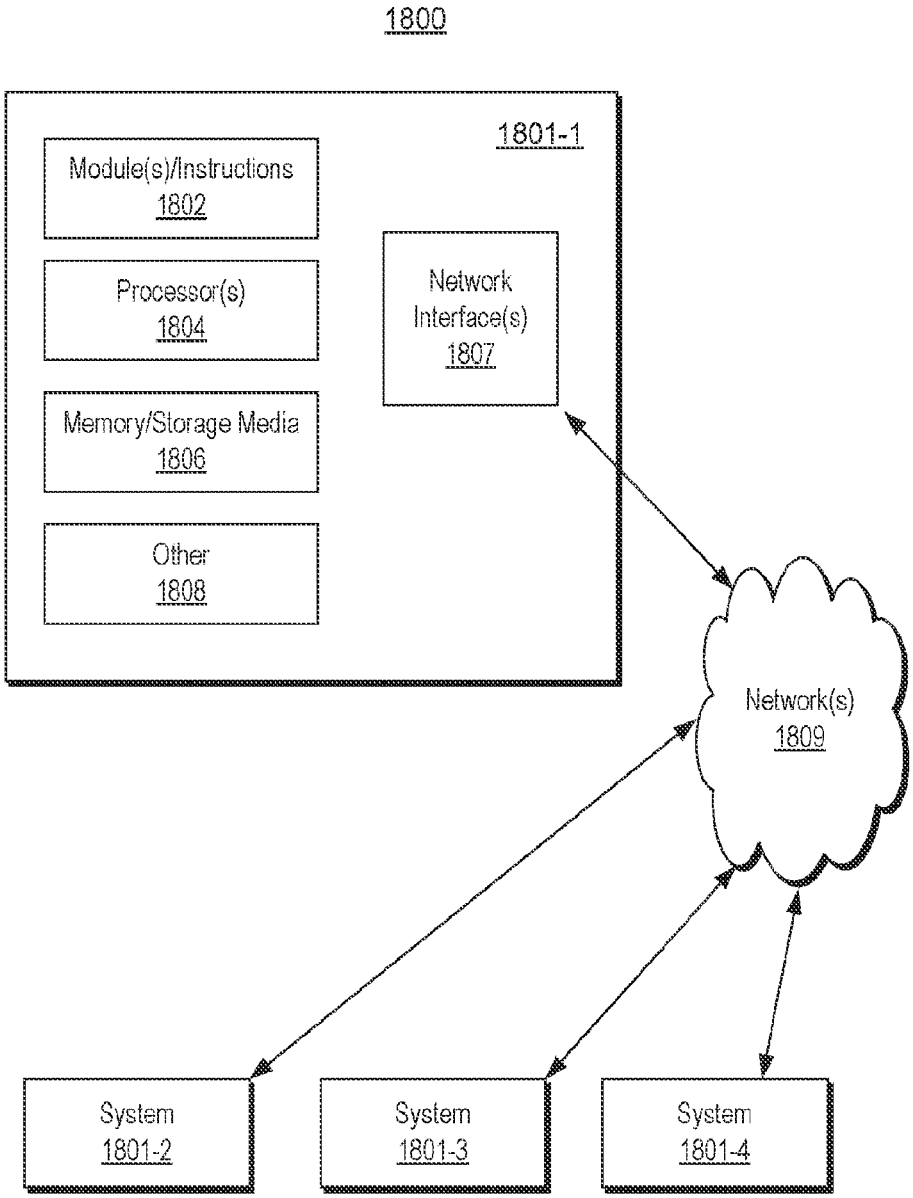
FIG. 18 illustrates examples of computer and network equipment.

In some embodiments, a method or methods may be executed by a computing system. FIG. 18 shows an example of a system 1800 that can include one or more computing systems 1801-1, 1801-2, 1801-3 and 1801-4, which may be operatively coupled via one or more networks 1809, which may include wired and/or wireless networks.

As an example, a system can include an individual computer system or an arrangement of distributed computer systems. In the example of FIG. 18, the computer system 1801-1 can include one or more modules 1802, which may be or include processor-executable instructions, for example, executable to perform various tasks (e.g., receiving information, requesting information, processing information, simulation, outputting information, etc.).

As an example, a module may be executed independently, or in coordination with, one or more processors 1804, which is (or are) operatively coupled to one or more storage media 1806 (e.g., via wire, wirelessly, etc.). As an example, one or more of the one or more processors 1804 can be operatively coupled to at least one of one or more network interface 1807. In such an example, the computer system 1801-1 can transmit and/or receive information, for example, via the one or more networks 1809 (e.g., consider one or more of the Internet, a private network, a cellular network, a satellite network, etc.).

As an example, the computer system 1801-1 may receive from and/or transmit information to one or more other devices, which may be or include, for example, one or more of the computer systems 1801-2, etc. A device may be located in a physical location that differs from that of the computer system 1801-1. As an example, a location may be, for example, a processing facility location, a data center location (e.g., server farm, etc.), a rig location, a wellsite location, a downhole location, etc.

As an example, a processor may be or include a microprocessor, microcontroller, processor module or subsystem, programmable integrated circuit, programmable gate array, or another control or computing device.

As an example, the storage media 1806 may be implemented as one or more computer-readable or machine-readable storage media. As an example, storage may be distributed within and/or across multiple internal and/or external enclosures of a computing system and/or additional computing systems.

As an example, a storage medium or storage media may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLUERAY disks, or other types of optical storage, or other types of storage devices.

As an example, a storage medium or media may be located in a machine running machine-readable instructions or located at a remote site from which machine-readable instructions may be downloaded over a network for execution.

As an example, various components of a system such as, for example, a computer system, may be implemented in hardware, software, or a combination of both hardware and software (e.g., including firmware), including one or more signal processing and/or application specific integrated circuits.

As an example, a system may include a processing apparatus that may be or include general purpose processors or application specific chips (e.g., or chipsets), such as ASICs, FPGAs, PLDs, or other appropriate devices.

Figure 19:
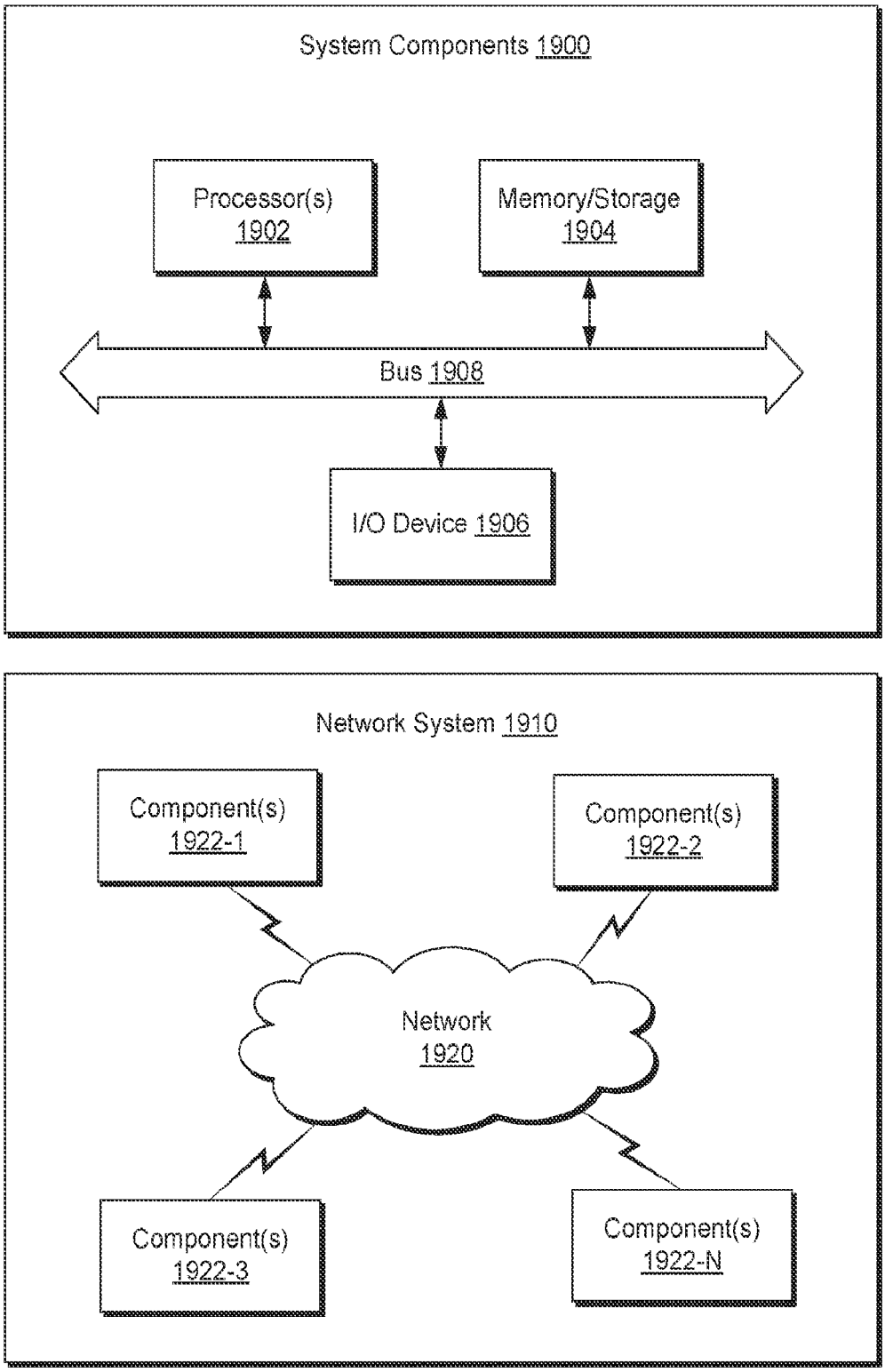
FIG. 19 illustrates example components of a system and a networked system.

FIG. 19 shows components of an example of a computing system 1900 and an example of a networked system 1910 with a network 1920. The system 1900 includes one or more processors 1902, memory and/or storage components 1904, one or more input and/or output devices 1906 and a bus 1908. In an example embodiment, instructions may be stored in one or more computer-readable media (e.g., memory/storage components 1904). Such instructions may be read by one or more processors (e.g., the processor(s) 1902) via a communication bus (e.g., the bus 1908), which may be wired or wireless. The one or more processors may execute such instructions to implement (wholly or in part) one or more attributes (e.g., as part of a method). A user may view output from and interact with a process via an I/O device (e.g., the device 1906). In an example embodiment, a computer-readable medium may be a storage component such as a physical memory storage device, for example, a chip, a chip on a package, a memory card, etc. (e.g., a computer-readable storage medium).

In an example embodiment, components may be distributed, such as in the network system 1910. The network system 1910 includes components 1922-1, 1922-2, 1922-3, . . . 1922-N. For example, the components 1922-1 may include the processor(s) 1902 while the component(s) 1922-3 may include memory accessible by the processor(s) 1902. Further, the component(s) 1922-2 may include an I/O device for display and optionally interaction with a method. The network 1920 may be or include the Internet, an intranet, a cellular network, a satellite network, etc.

As an example, a device may be a mobile device that includes one or more network interfaces for communication of information. For example, a mobile device may include a wireless network interface (e.g., operable via IEEE 802.11, ETSI GSM, BLUETOOTH, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

As an example, a system may be a distributed environment, for example, a so-called "cloud" environment where various devices, components, etc. interact for purposes of data storage, communications, computing, etc. As an example, a device or a system may include one or more components for communication of information via one or more of the Internet (e.g., where communication occurs via one or more Internet protocols), a cellular network, a satellite network, etc. As an example, a method may be implemented in a distributed environment (e.g., wholly or in part as a cloud-based service).

As an example, information may be input from a display (e.g., consider a touchscreen), output to a display or both. As an example, information may be output to a projector, a laser device, a printer, etc. such that the information may be viewed. As an example, information may be output stereographically or holographically. As to a printer, consider a 2D or a 3D printer. As an example, a 3D printer may include one or more substances that can be output to construct a 3D object. For example, data may be provided to a 3D printer to construct a 3D representation of a subterranean formation. As an example, layers may be constructed in 3D (e.g., horizons, etc.), geobodies constructed in 3D, etc. As an example, holes, fractures, etc., may be constructed in 3D (e.g., as positive structures, as negative structures, etc.).

Although only a few example embodiments have been described in detail above, those skilled in the art will readily appreciate that many modifications are possible in the example embodiments. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A method comprising:

implementing a control scheme for a plurality of wells;

using the control scheme, classifying each of the wells;

based on the classifying, identifying one or more of the wells as experiencing liquid loading; and issuing a control instruction to perform an unloading operation for the one or more of the wells.

2. The method of claim 1, wherein the unloading operation comprises a self-unloading operation or a manual unloading operation.

3. The method of claim 1, wherein the unloading operation comprises a self-unloading operation and comprising issuing another control instruction to perform a manual unloading operation after the self-unloading operation.

4. The method of claim 1, wherein the classifying comprises classifying each of the wells into one of at least three classes.

5. The method of claim 4, wherein the at least three classes comprises an intermediate class and wherein the control scheme comprises an intermediate control scheme that corresponds to the intermediate class and acts to minimize time wherein velocity is below a critical velocity.

6. The method of claim 4, wherein the at least three classes comprises an upper class and wherein the control scheme comprises a steady state control scheme that corresponds to the upper class and acts to adjust a gas rate set-point.

7. The method of claim 1, wherein the control scheme comprises states that are assigned according to a corresponding class of the classifying.

8. The method of claim 7, wherein the states comprise a steady state, an intermittent state and an unloading state.

9. The method of claim 1, wherein the classifying depends on a physics-based model.

10. The method of claim 9, wherein the physics-based model comprises differential equations that are solved to provide a solution wherein the solution is implemented to classify each of the wells.

11. The method of claim 1, wherein the control scheme comprises states defined via rules.

12. The method of claim 11, wherein the rules comprise logic rules.

13. The method of claim 11, wherein the rules depend on sensor-based values.

14. The method of claim 13, wherein the sensor-based values comprise pressure values.

15. The method of claim 11, wherein the rules comprise at least one time-dependent rule.

16. The method of claim 11, wherein the rules comprise at least one conjunction-dependent rule.

17. The method of claim 1, comprising implementing an autonomous choke control scheme for at least a portion of the wells.

18. The method of claim 1, wherein the control scheme comprises a closed-loop control scheme.

19. A system comprising:

a processor;

memory accessible to the processor;

processor-executable instructions stored in the memory and executable by the processor to instruct the system to:

implement a control scheme for a plurality of wells;

using the control scheme, classify each of the wells using classifications;

based on the classifications, identify one or more of the wells as experiencing liquid loading; and issue a control instruction to perform an unloading operation for the one or more of the wells.

20. One or more computer-readable storage media comprising processor-executable instructions to instruct a computing system to:

implement a control scheme for a plurality of wells;

using the control scheme, classify each of the wells using classifications;

based on the classifications, identify one or more of the wells as experiencing liquid loading; and issue a control instruction to perform an unloading operation for the one or more of the wells.

* * * * *